US006992598B2

(12) United States Patent
Poltorak

(10) Patent No.: US 6,992,598 B2
(45) Date of Patent: Jan. 31, 2006

(54) APPARATUS AND METHOD FOR PROVIDING TRAVEL INFORMATION

(76) Inventor: Alexander I. Poltorak, 128 W. Maple Ave., Monsey, NY (US) 10952

( * ) Notice: Subject to any disclaimer, the term of this patent is extended or adjusted under 35 U.S.C. 154(b) by 73 days.

(21) Appl. No.: 10/328,770

(22) Filed: Dec. 24, 2002

(65) Prior Publication Data

US 2003/0128139 A1 Jul. 10, 2003

Related U.S. Application Data

(60) Provisional application No. 60/341,579, filed on Jan. 10, 2002.

(51) Int. Cl.
*G08G 1/123* (2006.01)

(52) U.S. Cl. ..... 340/995.19; 340/995.23; 701/209

(58) Field of Classification Search ..... 340/995.1, 340/995.19, 995.23, 995.16, 995.12, 995.13; 701/201, 207, 208, 209, 211, 213
See application file for complete search history.

(56) References Cited

U.S. PATENT DOCUMENTS 5,272,638 A * 12/1993 Martin et al. ..... 455/456.5
5,291,412 A * 3/1994 Tamai et al. ..... 701/211
6,124,807 A * 9/2000 Heckeroth et al. ..... 340/908
6,205,398 B1 * 3/2001 Kobayashi et al. ..... 701/209
6,338,021 B1 * 1/2002 Yagyu et al. ..... 701/209
6,505,120 B2 * 1/2003 Yamashita et al. ..... 701/211
6,522,875 B1 * 2/2003 Dowling et al. ..... 455/414.3
6,571,174 B2 * 5/2003 Rigazio et al. ..... 701/209
6,591,189 B2 * 7/2003 Shimada ..... 701/209
6,741,926 B1 * 5/2004 Zhao et al. ..... 701/201

* cited by examiner

*Primary Examiner*—Brent A. Swarthout
(74) *Attorney, Agent, or Firm*—Paul Lerner, Esq.

(57) ABSTRACT

An apparatus and method for providing travel information, including a database for storing information regarding a travel area, wherein the information includes at least one of road information, street information, intersection information, and traffic control device information, a processor for processing a request for information regarding an optimal travel route from a present location of a vehicle to a destination, wherein the processor processes the request by utilizing the information stored in the database, and further wherein the processor identifies at least two possible travel routes to the destination, and further wherein the processor identifies an optimal travel route to the destination, wherein the processor generates a message containing travel directions or instructions corresponding to the optimal travel route, and an output device for outputting the information contained in the message.

15 Claims, 8 Drawing Sheets

APPARATUS AND METHOD FOR PROVIDING TRAVEL INFORMATION

FIELD OF THE INVENTION

The present invention pertains to an apparatus and method for providing travel information and, in particular, to an apparatus and method for determining and providing information regarding an optimal travel route to a destination.

BACKGROUND OF THE INVENTION

Millions of individuals around the world rely on travel by automobiles, buses, trucks, or other types of vehicles, for either business or pleasure, each and every day. Unfortunately, as the number of vehicles being utilized by the ever-increasing driving population continues to grow, the use of these vehicles causes increased congestion and increased traffic on our roadways.

Another problem which arguably stems from our reliance on vehicles is our need to travel to destinations which may not be totally or even remotely familiar. In some instances, these travel needs require unexpected travel directions or instructions on-the-fly. As one can readily appreciate, maps are not always available to a vehicle operator or occupant. Further, it is not always easy to obtain directions or instructions from an external source while operating a vehicle.

In this wireless information age, some vehicle manufacturers have installed wireless communication equipment in vehicles which can put a vehicle operator into contact with a service representative who may offer driving directions or instructions. Yet other vehicle manufacturers have offered navigational aids which can provide driving directions of instructions to a vehicle operator or occupant.

While the above-described products and services may provide some assistance to a vehicle operator or occupant, they do not appear to provide information regarding which one or more of a number of possible travel routes is an optimal travel route. In this regard, the above-described prior art products and services do not appear to provide information regarding travel routes which result in the shortest travel time, travel routes which involve the minimum number of turns, or travel routes which avoid traffic obstacles or encumbrances.

In this regard, the prior art fails to provide an apparatus and method for identifying an optimal travel route or routes from information regarding the travel area and for providing optimized travel directions or instructions to a vehicle operator or occupant.

SUMMARY OF THE INVENTION

The present invention pertains to an apparatus and method for providing travel information which overcomes the shortfalls of the prior art. The present invention pertains to an apparatus and method for providing travel information and, in particular, to an apparatus and method for determining and providing information regarding an optimal travel route to a destination.

The present invention can be utilized so as to provide travel information and/or directions regarding an optimal travel route from a present location, or a point of travel origin, to a destination. The travel information and/or directions can be provided to, and utilized by, a driver or other operating individual, or to any passengers or occupants of the vehicle.

The present invention can also be utilized so as to provide travel information or directions in any area or areas for which map information, street or roadway information, and/or information regarding traffic control devices, signs, and/or signals, can be obtained and/or documented. In this regard, the present invention can be utilized in urban areas, suburban areas, and/or rural areas, and/or in any combination of same.

The present invention can be utilized by a vehicle operator or occupant in order to obtain driving information, traffic information, and/or driving directions and/or instructions, for driving a vehicle from a point of origin, or present location, to a destination. The present invention can also provide directions and/or instructions regarding an optimal travel route, a travel route involving minimized travel time, and/or a travel route involving the minimum travel distance.

The present invention can also be utilized so as to provides in-vehicle information to a vehicle operator or occupant so as to allow the operator to be apprised of the shortest or fastest travel routes.

The apparatus and method of the present invention can be utilized in conjunction with vehicles of any type which include, but which is not limited to, vehicles, motor vehicles, automobiles, trucks, buses, and/or any other vehicles, land vehicles, etc.

The present invention can be utilized in conjunction with any type of area or travel area for which any of the data and/or information, described as being needed for the operation of the present invention, can be obtained. The present invention can also be utilized in connection with travel areas having various roads, intersections, traffic control devices and/or signals, including, but not limited to, traffic lights, stops sign, as well as other traffic control devices.

A vehicle can be equipped with a vehicle computer which can be installed and/or otherwise located in the vehicle. A central processing computer or server computer can also be utilized in order to provide processing service and/or to provide information to vehicle operators or occupants of vehicles located in a given geographic service area. Any one or more of traffic control devices, traffic signs, etc., can also have a computer or computer system assigned thereto for facilitating bi-directional communications with the central processing computer or server computer and/or with any of the vehicle computers.

The present invention can be utilized in order to provide the operator of the vehicle or an occupant of the vehicle with driving directions or instructions for enabling the vehicle operator to travel from a present location to a destination in the minimum amount of time, given the possible alternate routes which exist between the present location and the destination, traffic regulations, current traffic, current traffic conditions, etc.

The apparatus of the present invention can include the vehicle computer which is associated with a vehicle or with a vehicle operator or occupant. The vehicle computer can be any type of computer or communication device which can provide or perform the functionality described herein. The vehicle computer can be installed in the vehicle, can be removable or portably installed in the vehicle, and/or can be a mobile device which can be easily carried into and taken from the vehicle.

The apparatus can also include a central processing computer or server computer which can be a network computer, a server computer, an Internet server computer, a mainframe computer, and/or any other computer, computer system, any group or plurality of computers, and/or any group or plurality of computer systems, which can provide the processing functionality described herein and which can provide the described servicing functionality to any number of vehicle computers. The vehicle computer can communicate with and/or obtain and/or process information received from the central processing computer.

The central processing computer can provide information to any one or more of the vehicle computers which can be located in a service area. The central processing computer can also have a web site, web sites, an IP address, and/or IP addresses, associated therewith.

The apparatus can also include one more traffic control devices which can, for example, be any one or more of a traffic light, a traffic signal light, a flashing light, a message display device, a traffic sign (i.e. stop sign, a yield sign, a warning sign, etc.), and/or a traffic control sign, and/or any combination of same.

Any of the vehicle computers, the central processing computer or computers, and the traffic control device computers, can communication with each other in a bi-directional manner.

The apparatus of the present invention can be utilized on, over, and/or in conjunction with, any suitable communication network such as, but not limited to, a telecommunication network, the Internet, the World Wide Web, an RF signal communications network, a satellite communications network, an optical communications network, a public switched telephone network, a digital communications network, a personal communications services (PCS) communication network, and/or any other communication network or system, and/or any combination of same.

The central processing computer can provide service for any number of vehicle computers in a geographic area. The apparatus of the present invention can also be utilized in conjunction with any number of traffic control devices.

The vehicle computer can be any computer, computer system, and/or any suitably equipped communication device, having at least the components and peripheral devices described herein, which can be adapted for performing the processing routines and functionality described herein as being performed by the vehicle computer and/or the apparatus of the present invention.

The vehicle computer can also be utilized to perform any and/or all of the processing routines described herein and for communicating with the central processing computer(s) and/or with any of the herein-described traffic control device(s) which are utilized in conjunction with the present invention.

The vehicle computer includes a central processing unit or CPU. The vehicle computer can also include a read only memory device(s), a random access memory device(s), a user input device, for entering data and/or commands into the vehicle computer, and a display for displaying data and/or information to a vehicle operator or occupant.

The vehicle computer can also include a transmitter(s) for transmitting signals and/or data and/or information to any one or more of the central processing computer(s) and/or to any of the herein-described traffic control device(s), and a receiver for receiving signals and/or data and/or information from the central processing computer(s) and/or from any of the herein-described traffic control device(s).

The vehicle computer can also include a database(s) which can contain any and/or all of the data and/or information which may be needed and/or desired in performing the processing routines described herein, such as, but not limited to those routines for determining and providing any of the herein-described information, directions, and/or instructions, to the vehicle operator or occupant.

The data and/or information stored in the database(s) can be stored in, and be resident in, the database, can be obtained from, or loaded from, a compact disc (CD), a digital versatile disc (DVD), a magnetic tape, or any other storage medium. The information stored in the database can also be downloaded from the central processing computer(s) and/or any of the traffic control device(s).

The vehicle computer can also include a global positioning system (GPS) device which can be utilized for determining the position or location of the vehicle. The vehicle computer can also include an output device such as a printer, a modem, a fax/modem, or other output device, for providing data and/or information to the operator or occupant of the vehicle.

The vehicle computer can also include a voice synthesizing device system which can include at least a voice synthesizing device and associated speaker for providing audio voice information, directions, and/or instructions, to a vehicle operator or occupant(s). In this manner, voice synthesized driving information, directions, and/or instructions, can be provided to the operator or occupant of the vehicle.

The central processing computer can be any computer, computer system, network computer, server computer, and/or any suitably equipped communication device, having at least the components and peripheral devices described herein, which can be adapted for performing the processing routines and functionality described herein as being performed by the central processing computer and/or the apparatus of the present invention. The central processing computer can be utilized in order to provide any and all of the processing routines and functionality described herein for any number of vehicle computers. The central processing computer can also be utilized in order to provide any and all of the processing routines and functionality described herein for any number of traffic control devices.

The central processing computer can be utilized to perform any and/or all of the processing routines described herein and for communicating with any of the vehicle computers, with any of the herein-described traffic control device(s), and with any other central processing computer(s) which may be utilized.

The central processing computer includes a central processing unit or CPU. The central processing computer can also include a read only memory device(s) (ROM), a random access memory device(s), a user input device, for entering data and/or commands into the central processing computer, and a display device, for displaying data and/or information to an operator of the central processing computer.

The central processing computer can also include a transmitter(s), for transmitting signals and/or data and/or information to any one or more of the vehicle computers, to any of the herein-described traffic control device(s), and/or to any other central processing computer(s), which may be utilized. The central processing computer can also include a receiver, for receiving signals and/or data and/or information from any of the vehicle computers, from any of the traffic control device(s), and/or from any of the other central processing computer(s), which may be utilized.

The central processing computer can also include a database(s) which can contain any and/or all of the data and/or information which may be needed and/or desired in performing the processing routines described herein as being performed by the central processing computer, such as, but not limited to, routines for determining and providing any of the herein-described information, directions, and/or instructions, to any of the herein-described vehicle computers, and/or routines for facilitating communications and/or for interfacing with any of the vehicles computers, with any of the traffic control devices, and/or with any other central processing computers which may be utilized.

The data and/or information stored in the database can be stored in, and be resident in, the database, can be obtained from, or loaded from, any number of compact discs (CDs), digital versatile discs (DVDs), magnetic tapes, or any other storage mediums. The information stored in the database can also be downloaded from other central processing computer(s) and/or from any of the traffic control device(s) which may be utilized.

The central processing computer can also include an output device, for providing data and/or information to the operator of the central processing computer.

The traffic control device can be any traffic control device, traffic light, display device, message display device, or traffic sign, capable of having a processing functionality. The traffic control device can be, or can include, a computer, computer system, network computer, server computer, and/or any suitably equipped communication device, along with the functional devices of the respective traffic control device (i.e. traffic lights, message displays, blinking lights, etc.) and can further have any other components and peripheral devices described herein, which can be adapted for performing the processing routines and functionality described herein as being performed by the traffic control device and/or the apparatus of the present invention.

The traffic control device can be utilized to perform any and/or all of the processing routines and traffic control functions described herein and for communicating with any of the vehicle computers, with any of the central processing computers, and with any other traffic control devices, which may be utilized with the present invention.

The traffic control device can include a central processing unit or CPU. The traffic control device can also include a read only memory device(s) (ROM), a random access memory device(s) (RAM), a user input device, for entering data and/or commands into the traffic control device, and a display device, for displaying data and/or information to an operator of the traffic control device.

The traffic control device can also include the traffic control equipment which is associated with the traffic control device and which can be or include a respective traffic light, a flashing or blinking light, a traffic message display device, a controllable traffic sign, or any other equipment which can be associated with, or utilized in conjunction with, a respective traffic control device.

The traffic control device can also include a traffic speed sensor or sensing device which can be, or which can include, any one or more of the well known electrical sensors, optical sensors, laser sensors, mechanical sensors, or pneumatic sensors, which can be utilized for determining the speed of vehicles along a road or street, or through an intersection.

The traffic speed sensor can also utilize radar signals or optical signals to determine the speed(s) of vehicles. The traffic speed sensor can also be any suitable device for counting the number of vehicles which travel past a predetermined point in a pre-specified time interval, which can be utilized to determine an average speed of traffic flow.

The traffic control device can also include a transmitter(s), for transmitting signals and/or data and/or information to any one or more of the vehicle computers, to the central processing computer(s), and/or to any other traffic control device(s) which may be utilized.

The traffic control device can also include a receiver, for receiving signals and/or data and/or information from any of the vehicle computers, from the central processing computer(s), and/or from any other traffic control device(s) which may be utilized.

The traffic control device can also include a database(s) which can contain any and/or all of the data and/or information which may be needed and/or desired in performing the processing routines described herein as being performed by the traffic control device, such as, but not limited to, routines for controlling the operation of the traffic control device and for controlling traffic control signal light activation, message generation and/or display, and any other operations performed by, or capable of being performed by, the respective traffic control device.

The data and/or information stored in the database can be stored in, and be resident in, the database, can be obtained from, or loaded from, any number of compact discs (CDs), digital versatile discs (DVDs), magnetic tapes, or any other storage mediums, and/or can also be downloaded from other central processing computer(s) and/or from any of the traffic control device(s) which may be utilized.

The traffic control device can also include an output device for providing data and/or information to the operator or occupant of the traffic control device.

The present invention can be utilized in a number of embodiments in order to provide driving information, directions, and/or instructions, to a vehicle operator or occupant. In one embodiment, the present invention can be utilized in a vehicle computer "stand alone" embodiment wherein the vehicle computer can perform all of the processing routines and/or functionality which can be provided by the present invention.

In a "stand alone" embodiment, the vehicle computer can utilize data and/or information which is stored in its database, and/or which is obtained from a compact disc (CD), a digital video disc (DVD), a magnetic or other tape, and/or any other storage media, in order to provide driving information, directions, and/or instructions, for directing the vehicle operator or occupant from a present or known location to a pre-determined or pre-selected destination via an optimal travel route.

The optimal travel route can be the route traveled in the shortest amount of time, the route having the fewest or minimum number of turns along a travel route to a destination, the route having the fewest or minimum number of traffic lights, traffic signs or other traffic control devices encountered along a travel route to a destination, the route having the fewest or minimum number of travel encumbrances (i.e. road work, construction, accidents, bridges, tolls, etc.) encountered along a travel route to a destination, and/or any other criteria.

The vehicle computer can identify any number of optimal travel routes as it is recognized that oftentimes two or more travel routes may qualify as optimal travel routes.

The vehicle operator or occupant can enter information regarding the present location of the vehicle into the vehicle computer either manually, via a user input device, or automatically, via the global positioning system device.

The destination information can also be entered by the vehicle operator or occupant into the vehicle computer.

The vehicle computer can identify all possible travel routes from a present location to the destination. The vehicle computer can also determine the travel distance along each road or street, or segment thereof, for each leg of a travel route for each of the identified possible travel routes. The vehicle computer can also identify intersections which exist along each of the possible travel routes, along with identifying the existence of traffic control devices, traffic lights, traffic signals, etc., which exist along a travel route, for each of the possible travel routes.

The vehicle computer can process the information regarding the possible travel routes and determine the optimal travel route or optimal travel routes.

In one embodiment the vehicle computer can determine the optimal travel route or routes by utilizing information stored in the database which does not include the states of any of the various traffic control devices which may exist in a geographic area. In this manner, the present invention can determine an optimal travel route or routes in instances when green light on and off times for a traffic light or traffic lights along possible travel routes are not known.

In another embodiment, the states of any of the various traffic control devices, which may exist in a geographic area, can be known and can be pre-stored in the database of the vehicle computer. In this manner, the optimal travel route or routes can be determined by utilizing information regarding the time or times at which a traffic light turns green and the duration of the green light, for each traffic light or traffic lights along the possible travel routes.

The vehicle computer can also determine the optimal travel route or routes by generating and solving an equation representing the expected travel time along each of the possible travel routes. In instances when all relevant information is known or estimations of same are available, the present invention can calculate the travel time for each one of the possible travel routes. In instances, where unknown parameters exist, the present invention can solve a group of equations simultaneously by utilizing linear programming techniques or other techniques.

The vehicle computer can determine the optimal travel route or routes from the identified possible travel routes. The present invention can then compile the information regarding the travel directions and/or instructions regarding the optimal travel route.

The travel route information can then be provided to the vehicle operator or occupant, via the vehicle computer, by any one or more of displaying the travel directions or instructions on the display device, outputting the travel directions or instructions on the output device, or providing audible travel directions or instructions via the voice synthesizing device system.

In another embodiment, the central processing computer can be utilized in conjunction with the vehicle computer. In such an embodiment, the apparatus can operate in a network environment. In such a network environment embodiment, the vehicle computer can be utilized in conjunction with the central processing computer(s) and with any one or more of the traffic control devices which can be utilized in conjunction with the present invention.

The vehicle operator or occupant can access the central processing computer via the vehicle computer. The vehicle operator or occupant can enter information regarding the present location of the vehicle into the vehicle computer either manually, via the user input device, or automatically, via the global positioning system device. The present location information can then by transmitted to and received by the central processing computer.

The vehicle operator or occupant can then enter information regarding the desired destination into the vehicle computer. The destination information can also be transmitted from the vehicle computer to and received by the central processing computer.

The central processing computer can then process and store the present location or position information and the destination information. The central processing computer can identify all possible travel routes from a present location to the destination. The central processing computer can also determine the travel distance along each road or street, or segment thereof, for each leg of a travel route for each of the identified possible travel routes. The central processing computer can also identify intersections which exist along each of the possible travel routes and can also identify the existence of traffic control devices, traffic lights, traffic signals, etc., which exist along a travel route, for each of the possible travel routes.

The central processing computer can process the information regarding the possible travel routes and determine the optimal travel route or optimal travel routes. The central processing computer can utilized data and/or information which may be stored in its database or can obtain any needed and/or desired information such as, for example, a traffic control device green light on-time and green light on duration, traffic speed through, or at, an intersection or road section in the vicinity of a traffic control device, by accessing and obtaining the information from a respective traffic control device(s) which is/are identified as being on the identified possible travel route or travel routes.

The central processing computer(s) and the traffic control devices can be capable of communicating with each other in a bi-directional manner. In this regard, the central processing computer can obtain any of the needed data and/or information from a respective traffic control device, in real-time and/or otherwise.

In one embodiment, the central processing computer can determine the optimal travel route or routes by utilizing information which may or may not include information regarding the states of any of the various traffic control devices which may exist in a geographic area. In another embodiment, the central processing computer can obtain any missing and/or desired information directly from a respective traffic control device(s) and/or from any other central processing computer(s) which may be utilized in conjunction with the present invention.

In an embodiment where certain data and/or information is not available to the central processing computer and/or the central processing computer cannot obtain same from an external source, the optimal travel route or routes can be determined by the central processing computer by using estimated and/or stored estimations. In another embodiment, the states of any of the various traffic control devices, which may exist in a geographic area, can be known and can be pre-stored in the database of the central processing computer.

The central processing computer can determine the optimal travel route or routes by generating an equation representing the expected travel time along each of the possible travel routes. The central processing computer can utilize the same or similar processing algorithms which may be utilized by the vehicle computer in determining and identifying an optimal travel route.

The central processing computer can determine the equations for each of the possible travel routes. The central processing computer can than solve the equations to identity the optimal travel route. In an embodiment where no information regarding the on times or on duration for a green light of a traffic signal(s) is known or stored, but where an estimated average travel time though an intersection or road segment having such a traffic signal(s) is known, the central processing computer can calculate the estimated travel times for each of the possible travel routes.

In another embodiment, where on times and duration of green lights are known, the amount of time spent at an intersection or road section having the traffic light can be estimated by calculating the estimated time of arrival at the respective intersection or road section and then determining whether the light would be green or the amount of time which would have to elapse until the light turns green. In this manner, the time to travel through the intersection can be estimated.

In another embodiment, where no information regarding the on times or on duration for a green light of a traffic signal(s) is known or stored, and no estimated average travel time though an intersection or road segment having such a traffic signal(s) is available, the unknown information can be represented by an unknown variable and the central processing computer can solve the group of equations by utilizing linear programming techniques or other techniques.

The central processing computer can then identify the optimal travel route to the destination and compile the information regarding the travel directions and/or instructions regarding the optimal travel route.

The central processing computer can then transmit the optimal travel route information to the vehicle computer.

The vehicle computer can receive the optimal travel route information. The optimal travel route information can then be provided to the vehicle operator or occupant, via the vehicle computer, by any one or more of displaying the travel directions or instructions on the display device, outputting the travel directions or instructions via the output device, or providing audible travel directions or instructions via the voice synthesizing device system.

In any and/or all of the embodiments described herein, the central processing computer can, at any time, generate an information request message and transmit same to a traffic control device(s) in order to obtain operating characteristic information such as, green light on time or times, green light on time schedule or schedules, and/or green light on time duration or durations, from the respective device(s).

The respective traffic control device or devices can receive the request, process same, and generate a response message. Thereafter, the response message can be transmitted from the traffic control device to the central processing computer and can be received and utilized by the central processing computer in performing any of the herein-described processing routines and/or functionality.

Accordingly, it is an object of the present invention to provide an apparatus and method for providing travel information.

It is another object of the present invention to provide travel information regarding an optimal travel route to a destination.

It is still another object of the present invention to provide an apparatus and method for providing travel information, instructions, or directions, regarding an optimal travel route, to a vehicle operator or occupant.

It is yet another object of the present invention to provide an apparatus and method for providing travel information which can provide information regarding an optimal travel route in an urban area, a suburban area, a rural area, or any combination of same.

It is another object of the present invention to provide travel information regarding an optimal travel route to a destination wherein the optimal travel route involves the minimum travel time to a destination.

It is yet another object of the present invention to provide travel information regarding an optimal travel route to a destination wherein the optimal travel route involves the minimum number of turns along a travel route to a destination.

It is still another object of the present invention to provide travel information regarding an optimal travel route to a destination wherein the optimal travel route involves the minimum travel distance to a destination.

It is yet another object of the present invention to provide travel information regarding an optimal travel route which can be utilized in conjunction with any type of motor vehicle.

It is another object of the present invention to provide travel information regarding an optimal travel route which can be utilized in conjunction with travel areas having various roads, intersections, traffic control signals, including, but not limited to, traffic lights, stops sign, as well as other traffic control devices.

It is still another object of the present invention to provide travel information regarding an optimal travel route which can identify the optimal travel route from among a plurality of possible travel routes to a destination.

It is yet another object of the present invention to provide travel information regarding an optimal travel route which can be utilized on, over, and/or in conjunction with, any suitable communication network.

It is still another object of the present invention to provide travel information regarding an optimal travel route which can be utilized on, over, and/or in conjunction with, a telecommunication network, the Internet, the World Wide Web, an RF signal communications network, a satellite communications network, an optical communications network, a public switched telephone network, a digital communications network, a personal communications services (PCS) communication network, or any combination of same.

It is yet another object of the present invention to provide an apparatus and method for providing travel information regarding an optimal travel route which can provide service for any number of vehicle computers in a geographic area.

It is another object of the present invention to provide an apparatus and method for providing travel information regarding an optimal travel route which can perform optimal travel route processing solely with a computer located at the vehicle.

It is still another object of the present invention to provide an apparatus and method for providing travel information regarding an optimal travel route which can perform optimal travel route processing in conjunction with a central processing computer located externally from the vehicle.

It is yet another object of the present invention to provide an apparatus and method for providing travel information regarding an optimal travel route, wherein vehicle present location information can be entered manually.

It is another object of the present invention to provide an apparatus and method for providing travel information regarding an optimal travel route, wherein present location information can be obtained via a global positioning device located at the vehicle.

It is still another object of the present invention to provide an apparatus and method for providing travel information regarding an optimal travel route which can identify any number of possible travel routes from a present location to a destination.

It is yet another object of the present invention to provide an apparatus and method for providing travel information regarding an optimal travel route which can identify an optimal travel route to a destination from among a plurality of possible travel routes.

It is another object of the present invention to provide an apparatus and method for providing travel information regarding an optimal travel route which can identify optimal travel routes to a destination from among a plurality of possible travel routes.

It is another object of the present invention to provide an apparatus and method for providing travel information regarding an optimal travel route which can compile information, directions, and/or instructions, regarding an optimal travel route.

It is still another object of the present invention to provide an apparatus and method for providing travel information regarding an optimal travel route which can determine an optimal travel route by utilizing information which does not include information regarding the operation and/or the states of traffic control devices in an area of travel.

It is still another object of the present invention to provide an apparatus and method for providing travel information regarding an optimal travel route which can determine an optimal travel route by utilizing information which includes information regarding the operation and/or the states of traffic control devices in an area of travel.

It is yet another object of the present invention to provide an apparatus and method for providing travel information regarding an optimal travel route which can determine an optimal travel route by utilizing known, estimated, or observed, information regarding the operation and/or the states of traffic control devices in an area of travel.

It is another object of the present invention to provide an apparatus and method for providing travel information regarding an optimal travel route which can determine an optimal travel route by utilizing information containing unknown information regarding the operation and/or the states of traffic control devices in an area of travel.

It is another object of the present invention to provide an apparatus and method for providing travel information regarding an optimal travel route which can determine an optimal travel route by utilizing linear programming techniques.

It is still another object of the present invention to provide an apparatus and method for providing travel information regarding an optimal travel route which can be utilized in conjunction with a central processing computer in a network environment.

It is yet another object of the present invention to provide an apparatus and method for providing travel information regarding an optimal travel route which can provide travel directions or instructions via a display device.

It is yet another object of the present invention to provide an apparatus and method for providing travel information regarding an optimal travel route which can provide travel directions or instructions via an output device.

It is another object of the present invention to provide an apparatus and method for providing travel information regarding an optimal travel route which can provide travel directions or instructions via a voice synthesizing device system.

It is another object of the present invention to provide an apparatus and method for providing travel information regarding an optimal travel route which can obtain information from a traffic control device(s) regarding the operating characteristics of the respective traffic control device(s).

Other objects and advantages of the present invention will be apparent to those skilled in the art upon a review of the Description of the Preferred Embodiments taken in conjunction with the Drawings which follow.

DESCRIPTION OF THE PREFERRED EMBODIMENTS

The present invention pertains to an apparatus and method for providing travel information and, in particular, to an apparatus and method for determining and providing information regarding an optimal travel route to a destination.

The apparatus and method of the present invention can be utilized so as to provide travel information, instructions, and/or directions, regarding an optimal travel route from a present location, or a point of travel origin, to a destination. The travel information, instructions, and/or directions, can be provided to the driver or other operating individual, or to any occupants, or other individuals in the vehicle.

The apparatus and method of the present invention can be utilized so as to provide travel information, instructions, or directions, in any area or areas for which map information, street or roadway information, and/or information regarding traffic control devices, signs, and/or signals, can obtained and/or documented.

The apparatus and method of the present invention can be utilized to provide travel information, instructions, and/or directions, to a vehicle operator or vehicle occupant regarding travel in urban areas, suburban areas, and/or rural areas, and/or in any combination of same.

The apparatus and method of the present invention can be utilized by a vehicle operator or occupant in order to obtain driving information, traffic information, and/or driving directions and/or instructions, for driving a vehicle from a point of origin or a present location to a destination. The apparatus and method of the present invention can provide directions and/or instructions regarding an optimal travel route, a travel route involving minimized travel time, and/or a travel route involving the minimum travel distance. In this manner, the apparatus and method of the present invention can provide in-vehicle information to a vehicle operator or occupant so as to allow the operator to be apprised of the shortest or fastest travel routes.

The apparatus and method of the present invention can be utilized in conjunction with vehicles of any type which can include, but which is not limited to, vehicles, motor vehicles, automobiles, buses, trucks, and/or any other vehicles, land vehicles, etc.

Figure 1:
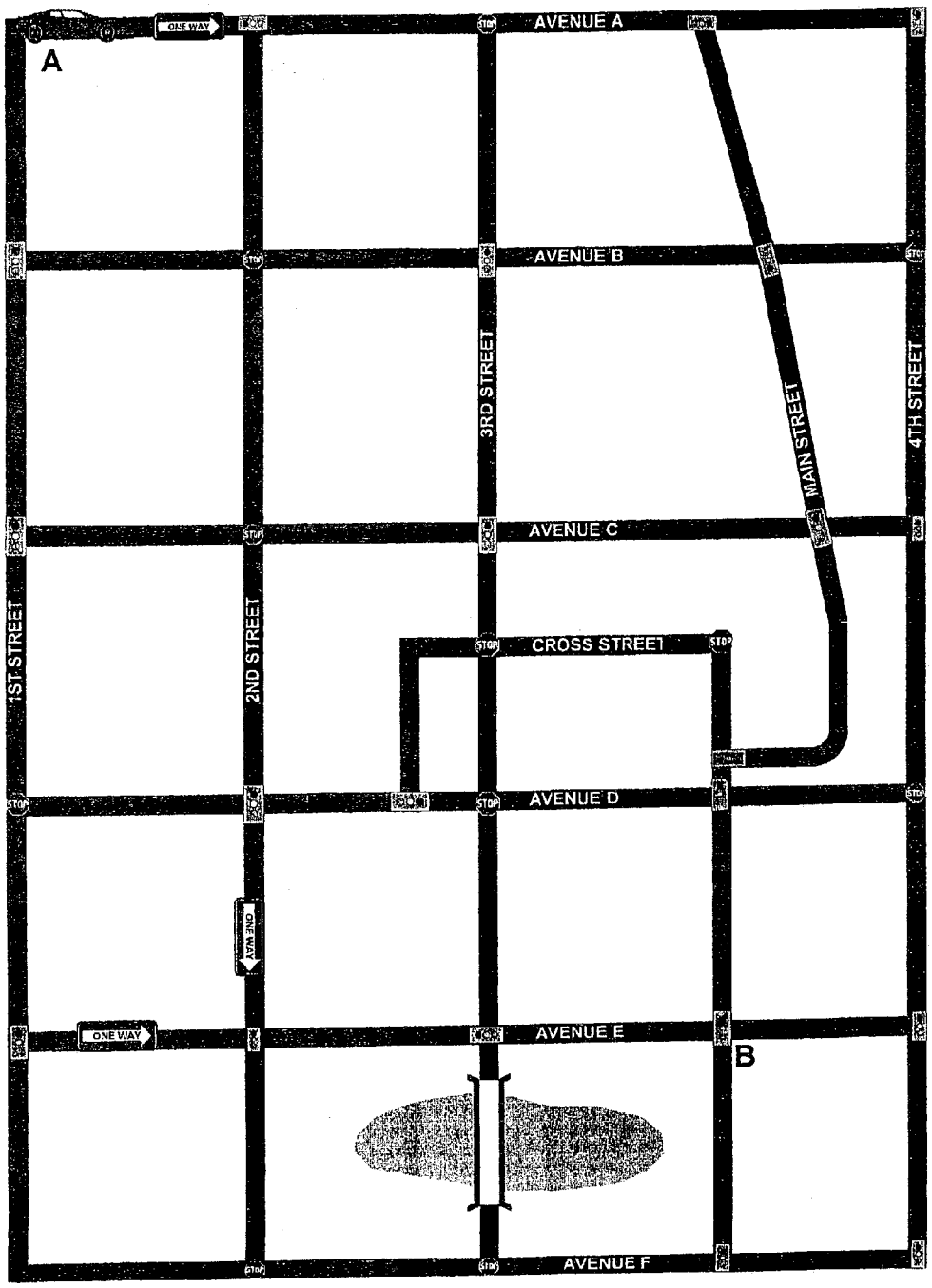
FIG. 1 illustrates a road map of an exemplary area in which the apparatus and method of the present invention can be utilized.

FIG. 1 illustrates a road map of an exemplary area in which the apparatus and method of the present invention can be utilized. It is important to note, however, that the apparatus and method of the present invention can be utilized in conjunction with any type of area or travel area for which any of the data and/or information, described herein as being needed for the operation of the present invention, can be obtained and/or documented.

With reference to FIG. 1, a road map is illustrated showing a vehicle 10, in which a vehicle computer (not shown) is utilized, traveling from a starting point A to a destination B. As is illustrated in FIG. 1, the area depicted therein illustrates the various roads, intersections, traffic control devices, including, but not limited to, traffic lights, stops sign, as well as other traffic control devices (not shown), which are located in the area.

As will be described in further detail below, the vehicle 10 will have a vehicle computer (not shown) which is installed therein and/or otherwise located therein or thereat. A central processing computer or server computer (not shown) may be utilized, in a preferred embodiment, in order to provide processing service and/or to provide information to vehicle operators or vehicle occupants of vehicles which may be located in, or traveling in, a geographic area being serviced by the central processing computer or server computer.

In a preferred embodiment, any one or more of the traffic control devices, traffic signs, etc., can also have a computer or computer system assigned thereto for facilitating bi-directional communications with the central processing computer or server computer and/or with any of the vehicle computers.

As will be described herein, the apparatus and method of the present invention can be utilized in order to provide the operator of the vehicle or an occupant of the vehicle with driving directions or instructions for enabling the vehicle operator to travel from point A to Point B in the minimum amount of time, given the possible alternate routes which exist between Point A and Point B, traffic regulations, current traffic, current traffic conditions, etc. For, example, and as will be described in more below, the apparatus and method of the present invention can assess the possible routes which the vehicle operator can take to go to Point B, determine which path would involve the projected shortest travel time and provide directions for the route having the shortest time to the vehicle operator.

Figure 2:
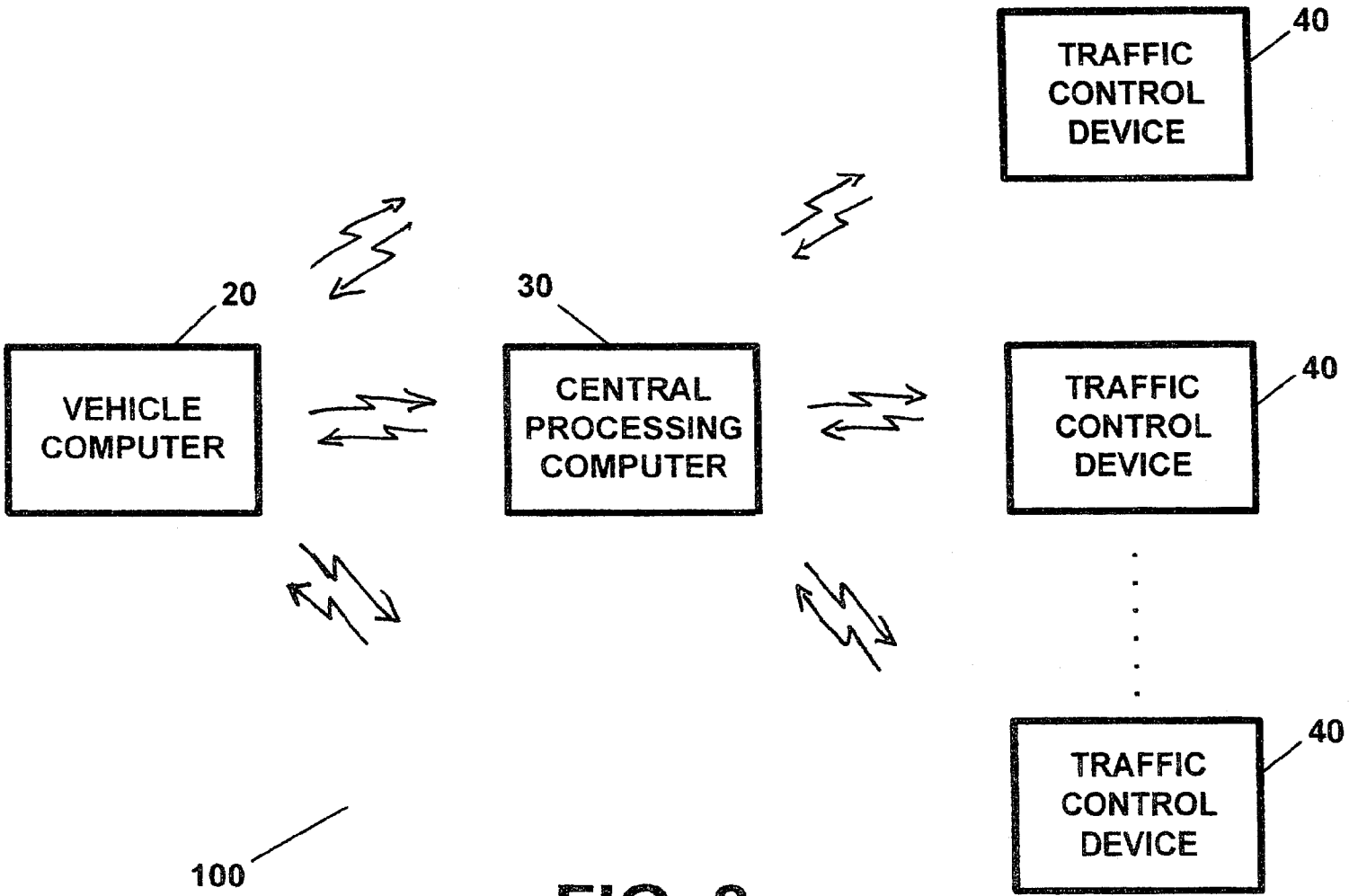
FIG. 2 illustrates a preferred embodiment of the apparatus of the present invention, in block diagram form.

FIG. 2 illustrates a preferred embodiment of the apparatus of the present invention, in block diagram form. The apparatus of FIG. 2 is designated generally by the reference numeral 100. With reference to FIG. 2, the apparatus 100 includes the vehicle computer 20 which is associated with a vehicle or with a vehicle operator or occupant. The vehicle computer 20 can be any type of computer or communication device which can provide, or which can perform, the functionality described herein.

In a preferred embodiment, the vehicle computer 20 can be installed in the vehicle, can be removable or portably installed in the vehicle, and/or can be a mobile device which can be easily carried into and from the vehicle. The vehicle computer 20 can be a self-contained and fully integrated device which can be capable of performing any and/or all of the processing routines and functionality described herein as being performed by the apparatus and method of the present invention.

With reference to FIG. 2, the apparatus 100 can also include a central processing computer or server computer 30 (hereafter referred to as "central processing computer 30"). The central processing computer 30 can be a network computer, a server computer, an Internet server computer, a mainframe computer, and/or any other computer, computer system, any group or plurality of computers, and/or any group or plurality of computer systems, which can provide the processing functionality described herein for any number of vehicle computers. In another preferred embodiment, the vehicle computer 20 can communicate with and/or obtain and/or process information received from the central processing computer 30.

The central processing computer 30 can provide information to any one or more of the vehicle computers 20 which can be located in a service area. The central processing computer 30 can also have a web site or web sites associated therewith. The central processing computer 40 can also have an IP address or IP addresses assigned thereto.

The apparatus 100 can also include one more traffic control devices 40. The traffic control devices 40 can be any one more of a traffic light, a traffic signal light, a flashing light, a message display device, a traffic sign (i.e. stop sign, a yield sign, a warning sign, etc.), and/or a traffic control sign, and/or any combination of same.

Any of the vehicle computers 20, the central processing computer or computers 30, and the traffic control devices 40, can communication with one other in a bi-directional manner. Any of the traffic control devices 40 can also can also have an IP address assigned thereto and/or associated therewith and/or a web site assigned thereto and/or associated therewith.

The apparatus 100 of FIG. 2, in the preferred embodiment, can be utilized on, over, and/or in conjunction with, any suitable communication network such as, but not limited to, a telecommunication network, the Internet, the World Wide Web, an RF signal communications network, a satellite communications network, an optical communications network, a public switched telephone network, a digital communications network, a personal communications services (PCS) communication network, and/or any other communication network or system, and/or any combination of same.

As noted above, in the embodiment of FIG. 2, the vehicle computer 20 can communicate with the central processing computer 30 in a bi-directional manner. In this manner, the vehicle computer 20 can transmit signals to, and receive signals from, the central processing computer 30. The central processing computer 30 can also transmit signals to, and receive signals from, the vehicle computer 20.

The central processing computer 30 can also transmit signals to, and receive signals from, any one or more of the traffic control devices 40 utilized in conjunction with the present invention. The vehicle computer 20 can also transmit signals to, and receive signals from, any of the one or more traffic control devices 40. The traffic control devices 40 can also transmit signals to, and receive signals from, the central processing computer 30 and the vehicle computer 20.

In the preferred embodiment, the central processing computer 30 can provide service for any number of vehicle computers 20 in a geographic area. In the preferred embodiment, the apparatus can include any number of traffic control devices 40.

Figure 3:
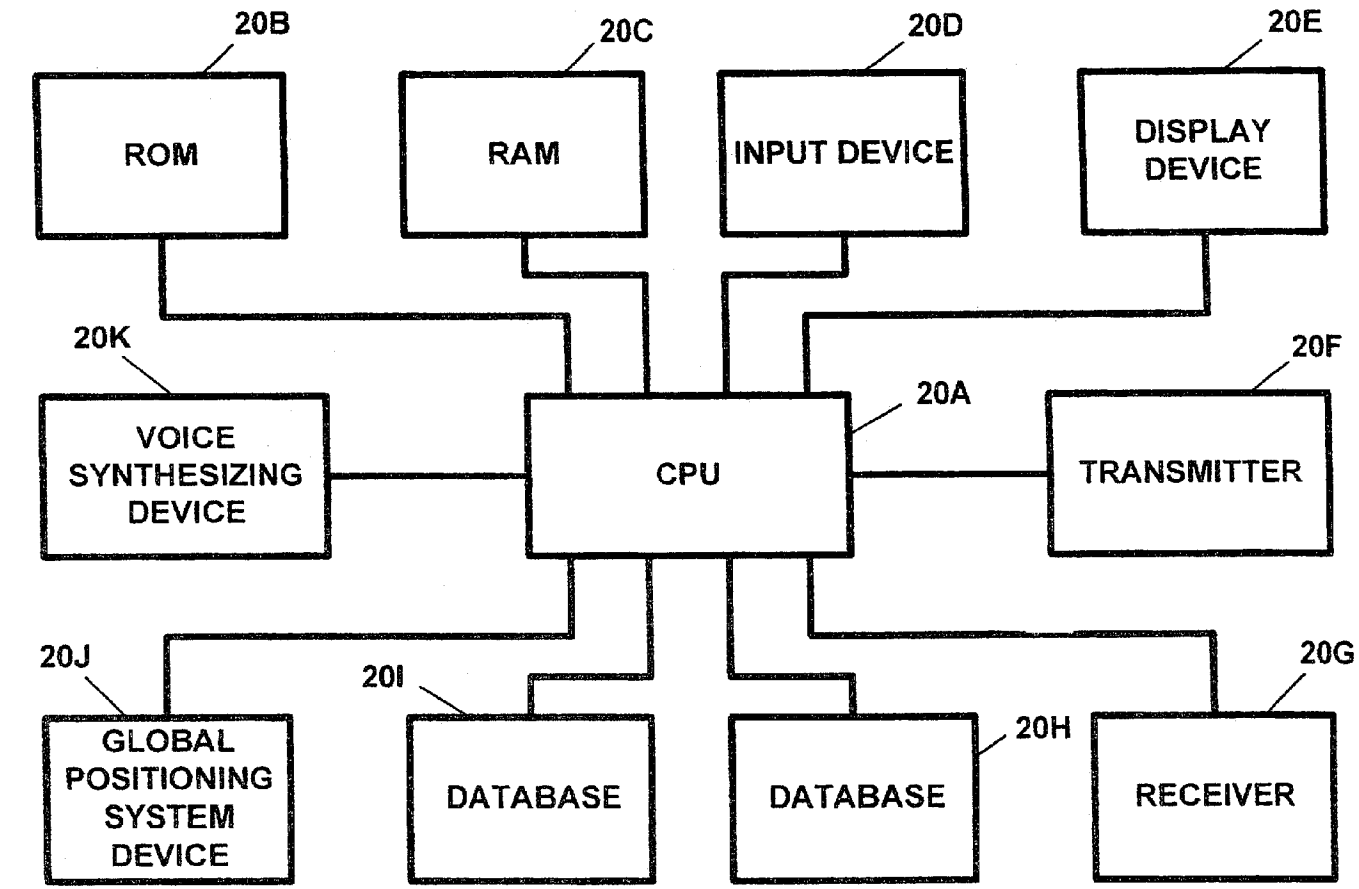
FIG. 3 illustrates the vehicle computer of FIG. 2, in block diagram form.

FIG. 3 illustrates the vehicle computer 20 of FIG. 2, in block diagram form. The vehicle computer 20 can be any computer, computer system, and/or any suitably equipped communication device, having at least the components and peripheral devices described herein, which can be adapted for performing the processing routines and functionality described herein as being performed by the vehicle computer 20 and/or by the apparatus 100 of the present invention.

With reference to FIG. 3, the vehicle computer 20, in the preferred embodiment, is utilized to perform any and/or all of the processing routines described herein and for communicating with any of central processing computer(s) 30 and/or any of the herein-described traffic control device(s) 40.

In the preferred embodiment, the vehicle computer 20 includes a central processing unit or CPU 20A, which in the preferred embodiment, is a microprocessor. The CPU 20A, depending upon the application, may also be a microcomputer, a minicomputer, a macro-computer, and/or a mainframe computer. The CPU 20A, in the preferred embodiment, performs all of the processing functions and control functions needed for controlling the operation of the vehicle computer 20 and any peripheral devices associated therewith.

The vehicle computer 20 also includes a read only memory device(s) 20B (ROM) and a random access memory device(s) 20C (RAM), each of which is connected to the CPU 20A, a user input device 20D, for entering data and/or commands into the vehicle computer 20, and which can include any one or more of a keyboard, a scanner, a user pointing device, such as, for example, a mouse, and/or a touch pad, which input device(s) are also connected to the CPU 20A. The user input device 20D can also include a microphone for inputting voice commands, present location information, and/or destination information, into the vehicle computer 20.

The vehicle computer 20 can also include a display device 20E for displaying data and/or information to a vehicle operator or occupant.

The vehicle computer 20 can also include a transmitter(s) 20F, for transmitting signals and/or data and/or information to any one or more of the central processing computer(s) 30, and/or to any of the herein-described traffic control device(s) 40, which are described as being utilized with the apparatus 100. The vehicle computer 20 can also include a receiver 20G, for receiving signals and/or data and/or information from the central processing computer(s) 30, and/or from any of the traffic control device(s) 40.

The vehicle computer 20 can also include a database(s) 20H which can contain any and/or all of the data and/or information which may be needed and/or desired in performing the processing routines described herein, such as, but not limited to, those routines for determining and providing any of the herein-described information, directions, and/or instructions, to the vehicle operator or occupant.

The database 20H can include map information in digital form or digitized form, geographical map information, area map information, road or street information, road or street location information, road or street name information, road or street location information, road or street position information, road or street coordinate information, road or street name, road or street intersection information, including road(s) or street(s) intersecting with same, the location of the respective intersection(s), the position of the respective intersection(s), the coordinates of the respective intersection(s), allowed direction of travel (i.e. one-way street, two-way street), allowed speed of travel on a respective road or street, posted speed limit on a respective road or street, length of road or street, distance between intersections on a road or street, traffic control devices (i.e. traffic lights, stop signs, etc.) on a road, street, or intersection, and any other information which may be needed and/or desired in facilitating the operation of the apparatus and method of the present invention, for each road or street or other travel thoroughfare, associated with an area for which a map or map information can or may be utilized.

The database 20H can also contain, for each of the herein-described roads, streets, intersections, traffic control devices, traffic control signals, traffic signs, etc., positional information or location information which can include X and Y coordinate data and/or information.

The database 20H can also contain, for each road or street, data and/or information regarding allowed turns (i.e. left or right turn allowed, right turn only allowed, left turn only allowed, no turns allowed, etc.), road or street direction of travel (i.e. north, northeast, east, southeast, south, southwest, west, northwest, etc.), traffic directions (i.e. one-way, two-way, etc.), and any other information regarding a characteristic of a road or street such as, for example, a through road or street or a dead end road or street.

The database 20H can also contain identification information and/or identifiers for each road, street, intersection, or any landmarks in a map area (i.e. hospital, school, park, bridge, museum, etc.).

The database 20H can also contain IP address information for each central processing computer 30 which can service a geographical area, IP address information for each traffic control device 40 in a geographical area, and/or another related information.

The database 20H can also contain pre-stored travel routes, pre-stored alternate travel routes, and any information relating thereto for any commonly known or popular travel routes, for any routes leading to a commonly known or popular travel destination, and/or any routes leading from a commonly known or popular travel origin. The database 20H can also contain, for any pre-stored routes, the travel distances of the routes, average speed along the route, number of turns involved along the route, and any other information regarding the route.

The database 20H can also contain information regarding the on times and off times of traffic control devices 40, green light on times, red light on times, frequency of green light to red light transition, etc., for each respective traffic control device 40.

The database 20H can also contain information regarding the observed average speed of travel of vehicles on a road or street and/or through an intersection, the average speed of travel of vehicles on a road or street and/or through an intersection, the average time a vehicle stops at a traffic control device (i.e. traffic light, etc.) or traffic signal (i.e. stop sign, yield sign, or other traffic sign(s)), the observed average speed of travel of vehicles on a road or street and/or in the vicinity of a traffic control device or traffic sign, the average speed of travel of vehicles on a road or street in the vicinity of a traffic control device or traffic sign, the average speed of travel of vehicles on a road or street in the absence of a traffic control device or traffic sign, and/or any other data and/or information regarding known, observed, or recorded, characteristics regarding travel in a geographic area.

The database 20H can also include the distance of travel along a road, a street, or a segment thereof, between intersections, the distance of travel through an intersection or a segment of a road or street in the vicinity of a traffic control device, the average speed of travel along a road, a street, or a segment of same, the average speed of travel through an intersection or a segment of a road or street in the vicinity of a traffic control device, the observed and/or estimated average speed of travel through an intersection or a segment of a road or street in the vicinity of a traffic control device, the average time of travel through an intersection or a segment of a road or street in the vicinity of a traffic control device, and the observed and/or estimated time of travel through an intersection or a segment of a road or street in the vicinity of a traffic control device.

The database 20H can also contain information regarding IP addresses for any of the central processing computers 30 and for any of the traffic control devices 40 which can be utilized in conjunction with the present invention. The database 20H can also contain any other information (i.e. use characteristics, etc.), not previously described herein, for and/or regarding any of the roads, streets, intersections, and/or traffic control devices, traffic signals, etc., described herein.

The database 20H can also contain data and/or information regarding pre-determined routes to a destination from a given location, pre-determined fastest routes, pre-determined lowest congestion routes, pre-determined routes which involve the minimum number of turns in order to reach a destination from a given location, and/or any other related data and/or information.

The database 20H can also contain software programs and/or processing algorithms and/or routines for data and/or information processing for determining routes to a destination from a given location, for determining fastest routes, for determining lowest congestion routes, for determining routes which involve the minimum number of turns in order to reach a destination from a given location, and/or for determining any other related data and/or information.

The database 20H can also contain any other information described herein as being stored in and/or utilized by any of the respective central processing computers 30 and/or traffic control devices 40 which are utilized in conjunction with the apparatus and method of the present invention.

The data and/or information which is stored in the database 20H can be resident therein and/or can be obtained from, or loaded from, a compact disc (CD), a digital versatile disc (DVD), a magnetic tape, or any other storage medium. The information stored in the database 20H can also be downloaded from the central processing computer(s) 30 and/or from any of the traffic control device(s) 40.

With reference once again to FIG. 3, the vehicle computer 20 also includes a global positioning system (GPS) device 20I which can be utilized for determining the position or location of the vehicle. The vehicle computer 20 can also include an output device 20J, such as a printer, a modem, a fax/modem, or other output device, for providing data and/or information to the operator or occupant of the vehicle.

With reference once again to FIG. 3, the vehicle computer 20 can also include a voice synthesizing device system 20K which can include at least a voice synthesizing device and associated speaker for providing audio voice information, directions, and/or instructions, to a vehicle operator or occupant(s). In this manner, voice synthesized driving information, directions, and/or instructions, can be provided to the operator or occupant of the vehicle.

Figure 4:
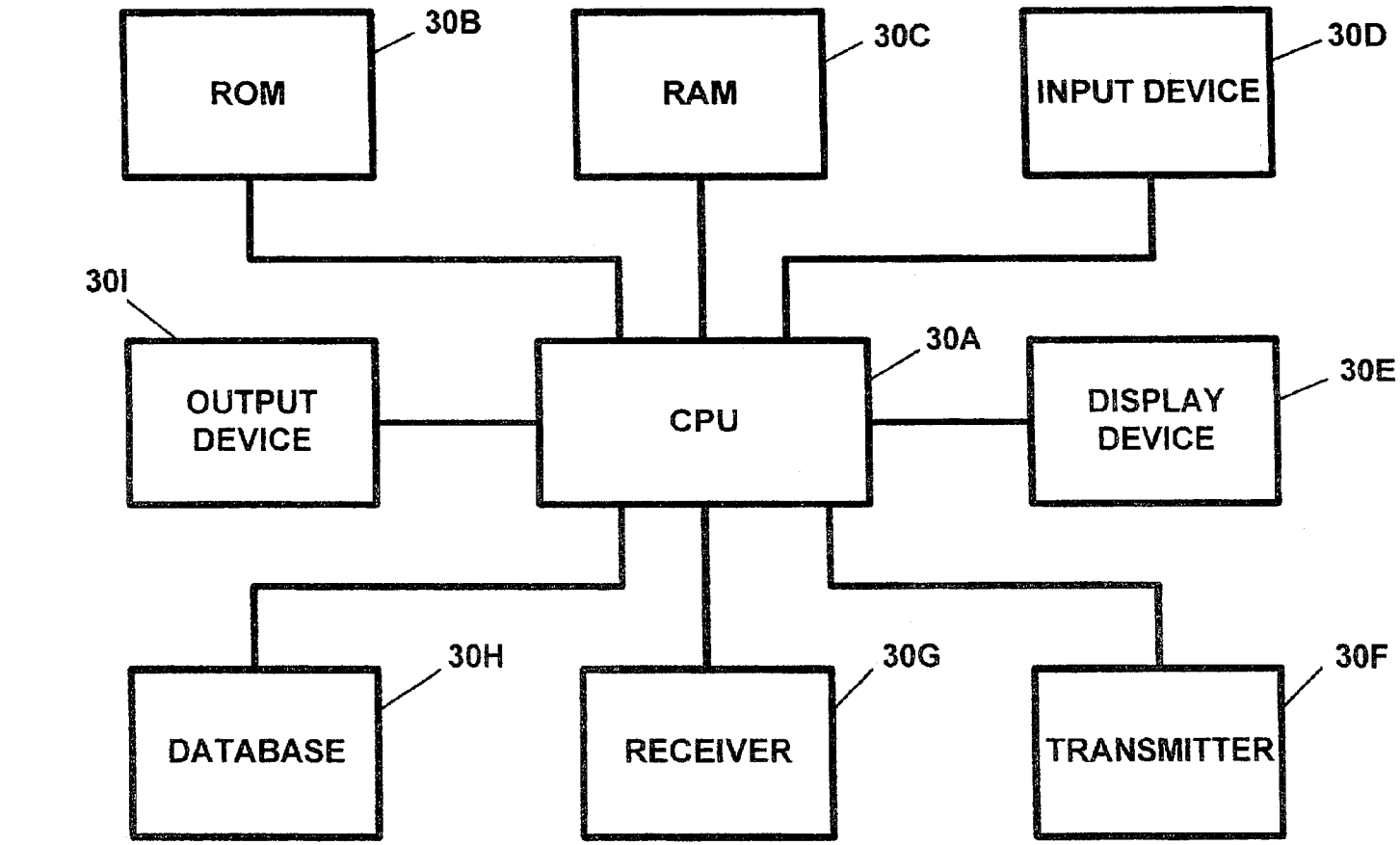
FIG. 4 illustrates the central processing computer of FIG. 2, in block diagram form.

FIG. 4 illustrates the central processing computer 30 of FIG. 2, in block diagram form. The central processing computer 30 can be any computer, computer system, network computer, server computer, and/or any suitably equipped communication device, having at least the components and peripheral devices described herein, which can be adapted for performing the processing routines and functionality described herein as being performed by the central processing computer 30 and/or the apparatus 100 of the present invention.

The central processing computer 30 can be utilized in order to provide any and/or all of the processing routines and functionality described herein for any number of vehicle computers 20. The central processing computer 30 can also be utilized in order to provide any and/or all of the processing routines and functionality described herein for any number of traffic control devices 40.

With reference to FIG. 4, the central processing computer 30, in the preferred embodiment, is utilized to perform any and/or all of the processing routines described herein and for communicating with any of the vehicle computers 20, with any of the herein-described traffic control device(s) 40, and with any of the other central processing computers 30, which may be utilized.

In the preferred embodiment, the central processing computer 30 includes a central processing unit or CPU 30A, which in the preferred embodiment, is a microprocessor. The CPU 30A, depending upon the application, may also be a microcomputer, a minicomputer, a macro-computer, and/or a mainframe computer. The CPU 30A, in the preferred embodiment, performs all of the processing functions and control functions needed for controlling the operation of the central processing computer 30 and any peripheral devices associated therewith.

The central processing computer 30 also includes a read only memory device(s) 30B (ROM) and a random access memory device(s) 30C (RAM), each of which is connected to the CPU 30A, a user input device 30D, for entering data and/or commands into the central processing computer 30, and which includes any one or more of a keyboard, a scanner, a user pointing device, such as, for example, a mouse, and/or a touch pad, which input device(s) are also connected to the CPU 30A. The user input device 30D can also include a microphone for inputting voice commands into the central processing computer 30. The central processing computer 30 can also include a display device 30E for displaying data and/or information to an operator of the central processing computer 30.

The central processing computer 30 can also include a transmitter(s) 30F, for transmitting signals and/or data and/or information to any one or more of the vehicle computers 20, to any of the herein-described traffic control device(s) 40, and/or to any other central processing computer(s) 30, which are described as being utilized with the apparatus 100. The central processing computer 30 can also include a receiver 30G, for receiving signals and/or data and/or information from any of the vehicle computers 20, from any of the traffic control device(s) 40, and/or from any of the other central processing computer(s) 30, which are described as being utilized with the apparatus 100.

The central processing computer 30 can also include a database(s) 30H which can contain any and/or all of the data and/or information which may be needed and/or desired in performing the processing routines described herein as being performed by the central processing computer 30, such as, but not limited to, routines for determining and providing any of the herein-described information, directions, and/or instructions, to any of the herein-described vehicle computers 20, and/or routines for facilitating communications and/or interfacing with any of the vehicles computers 20, with any of the traffic control devices, and/or with any other central processing computers 30 which may be utilized.

The database 30H can also contain map information in digital form or digitized form, geographical map information, area map information, road or street information, road or street location information, road or street name information, road or street location information, road or street position information, road or street coordinate information, road or street name, road or street intersection information including road(s) or street(s) intersecting with same, the location of the respective intersection(s), the position of the respective intersection(s), the coordinates of the respective intersection(s), allowed direction of travel (i.e. one-way street, two-way street), allowed speed of travel on a respective road or street, posted speed limit on a respective road or street, length of road or street, distance between intersections on a road or street, traffic control devices (i.e. traffic lights, stop signs, etc.) on a road, street, or intersection, and any other information which may be needed and/or desired in facilitating the operation of the apparatus and method of the present invention, for each road or street or other travel thoroughfare, associated with an area or areas for which a map or map information can or may be utilized, and/or for any and/or all areas which are being serviced by the central processing computer 30.

The database 30H can also contain for each of the herein-described roads, streets, intersections, traffic control devices, traffic control signals, traffic signs, etc, positional information or location information which can include X and Y coordinate data and/or information.

The database 30H can also contain, for each road or street, data and/or information regarding allowed turns (i.e. left or right turn allowed, right turn only allowed, left turn only allowed, no turns allowed, etc.), road or street direction of travel (i.e. north, northeast, east, southeast, south, southwest, west, northwest, etc.), traffic directions (i.e. one-way, two-way, etc.), and any other information regarding a characteristic of a road or street such as, for example, a through road or street or a dead end road or street.

The database 30H can also contain identification information and/or identifiers for each road, street, intersection, or any landmarks in the map area (i.e. hospital, school, park, bridge, museum, etc.) in the area or areas serviced by the central processing computer 30.

The database 30H can also contain IP address information for each traffic control device(s) 40 in a geographical area, and for any other central processing computers 30 which are or which may be utilized, and/or any another related information.

The database 30H can also contain pre-stored travel routes, pre-stored alternate travel routes, and any information relating thereto for any commonly known or popular travel routes, for any routes leading to a commonly known or popular travel destination, and/or any routes leading from a commonly known or popular travel origin. The database 30H can also include, for any pre-stored routes, the travel distances of the routes, the average speed along the route, the number of turns involved along the route, and any other information regarding the route.

The database 30H can also contain information regarding the on times and off times of traffic control devices, green light on times, red light on times, frequency of green light to red light transition, etc., for each respective traffic control device or traffic light.

The database 30H can also contain information regarding the observed average speed of travel of vehicles on a road or street and/or through an intersection, the average speed of travel of vehicles on a road or street and/or through an intersection, the average time a vehicle stops at a traffic control device (i.e. traffic light, etc.) or traffic signal (i.e. stop sign, yield sign, or other traffic sign(s)), the observed average speed of travel of vehicles on a road or street and/or in the vicinity of a traffic control device or traffic sign, the average speed of travel of vehicles on a road or street in the vicinity of a traffic control device or traffic sign, the average speed of travel of vehicles on a road or street in the absence of a traffic control device or traffic sign, and/or any other data and/or information regarding known, observed, or recorded, characteristics regarding travel in a geographic area.

The database 30H can also include the distance of travel along a road, a street, or a segment thereof, between intersections, the distance of travel through an intersection or a segment of a road or street in the vicinity of a traffic control device, the average speed of travel along a road, a street, or a segment of same, the average speed of travel through an intersection or a segment of a road or street in the vicinity of a traffic control device, the observed and/or estimated average speed of travel through an intersection or a segment of a road or street in the vicinity of a traffic control device, the average time of travel through an intersection or a segment of a road or street in the vicinity of a traffic control device, and the observed and/or estimated time of travel through an intersection or a segment of a road or street in the vicinity of a traffic control device.

The database 30H can also contain information regarding IP addresses for any of the vehicle computers 20, if utilized, for any of the traffic control devices 40 which are utilized, and for any of the other central processing computers 30 which may be utilized in conjunction with the present invention. The database 30H can also contain information (i.e. use characteristics, etc.), not previously described herein, for and/or regarding any of the roads, streets, intersections and/or traffic control devices, traffic signals, etc., which are described herein.

The database 30H can also contain data and/or information regarding pre-determined routes to a destination from a given location, pre-determined fastest routes, pre-determined lowest congestion routes, pre-determined routes which involve the minimum number of turns in order to reach a destination from a given location, and/or any other related data and/or information.

The database 30H can also contain software programs and/or processing algorithms and/or routines for data and/or information processing for determining routes to a destination from a given location, for determining fastest routes, for determining lowest congestion routes, for determining routes which involve the minimum number of turns in order to reach a destination from a given location, and/or for determining any other related data and/or information.

The database 30H can also contain information regarding vehicle owners or operators who may subscribe to the services provided by the apparatus 100 or the central processing computer 30.

The database 30H can also contain any other data and/or information described herein as being stored in and/or utilized by any of the respective vehicle computers 20 and/or the traffic control devices 40 which are utilized in conjunction with the apparatus and method of the present invention.

The data and/or information which is stored in the database 30H can be resident therein and/or can be obtained from, or loaded from, any number of compact discs (CDs), digital versatile discs (DVDs), magnetic tapes, or any other storage mediums. The information stored in the database 30H can also be downloaded from other central processing computer(s) 30 and/or from any of the traffic control device(s) 40 described herein.

The central processing computer 30 can also include an output device 30I, such as a printer, a modem, a fax/modem, or other output device, for providing data and/or information to the operator of the central processing computer 30.

Figure 5:
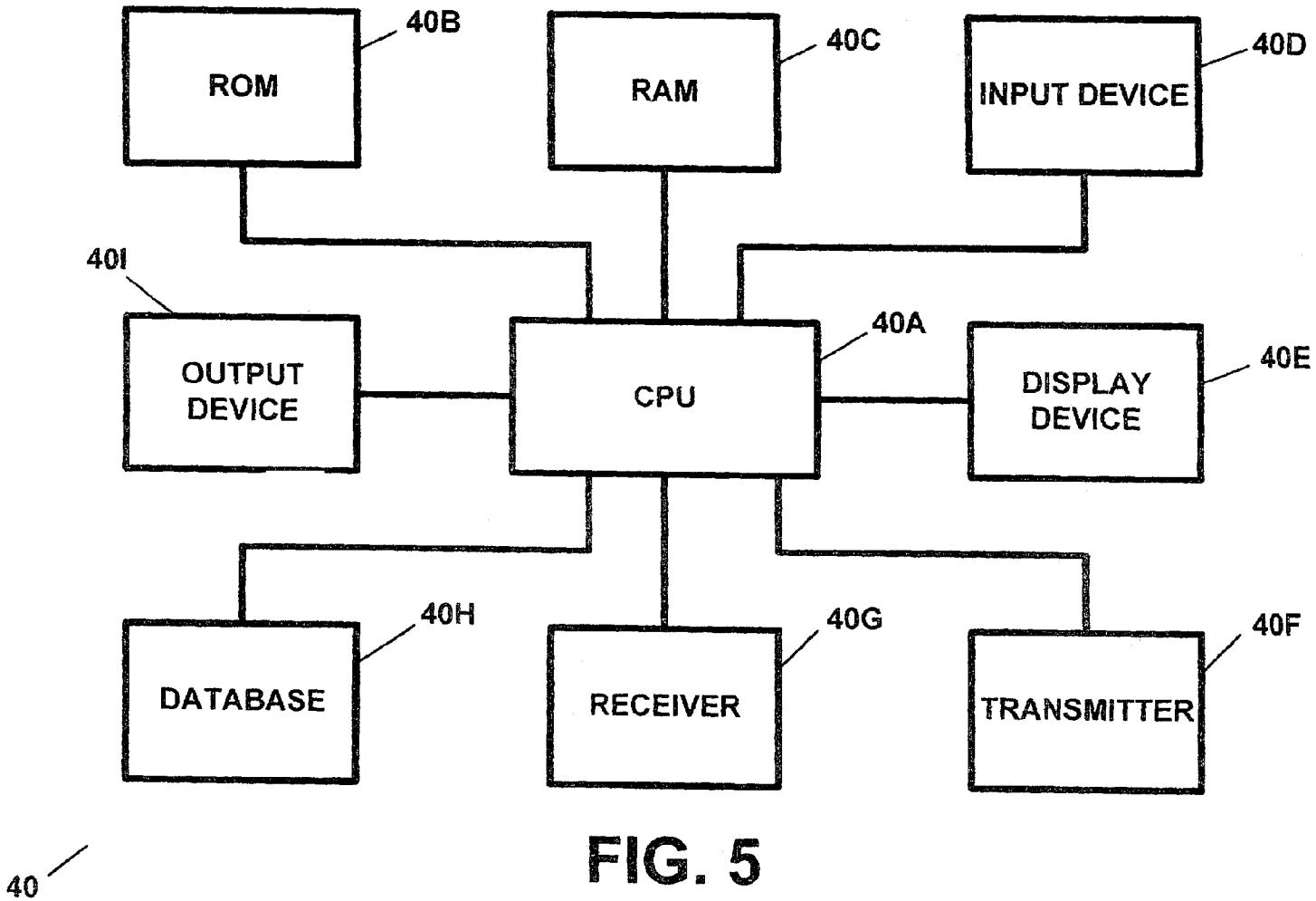
FIG. 5 illustrates the traffic control device of FIG. 2, in block diagram form.

FIG. 5 illustrates the traffic control device 40 of FIG. 2, in block diagram form. The traffic control device 40 can be any traffic control device, traffic light, display device, message display device, or traffic sign capable of having a processing functionality.

The traffic control device 40 can be, or can include, a computer, computer system, network computer, server computer, and/or any suitably equipped communication device, along with the functional devices of the respective traffic control device (i.e. traffic lights, message displays, blinking lights, etc.) and having any other components and peripheral devices described herein, which can be adapted for performing the processing routines and functionality described herein as being performed by the respective traffic control device 40 and/or the apparatus 100 of the present invention.

With reference to FIG. 5, the traffic control device 40, in the preferred embodiment, is utilized to perform any and/or all of the processing routines and traffic control functions described herein and for communicating with any of the vehicle computers 20, with any of the central processing computers 30, and/or with any of the other traffic control devices 40 which may be utilized with the present invention.

In the preferred embodiment, the traffic control device 40 includes a central processing unit or CPU 40A, which in the preferred embodiment, is a microprocessor. The CPU 40A, depending upon the application, may also be a microcomputer, a minicomputer, a macro-computer, and/or a mainframe computer.

The CPU 40A, in the preferred embodiment, performs all of the processing functions and control functions needed for controlling the operation of the traffic control device 40 and any peripheral devices associated therewith.

The traffic control device 40 also includes a read only memory device(s) 40B (ROM) and a random access memory device(s) 40C (RAM), each of which is connected to the CPU 40A, a user input device 40D, for entering data and/or commands into the traffic control device 40, and which can include any one or more of a keyboard, a scanner, a user pointing device, such as, for example, a mouse, and/or a touch pad, which input device(s) are also connected to the CPU 40A. The user input device 40D can also include a microphone for inputting voice commands into the traffic control device 40. The traffic control device 40 can also include a display device 40E for displaying data and/or information to an operator of the traffic control device 40.

The traffic control device 40 also includes the traffic control equipment 40F which is associated with the respective traffic control device 40. The traffic control equipment 40F is also connected to the CPU 40A. The traffic control equipment 40F can be a respective traffic light, a flashing or blinking light, a traffic message display device, a controllable traffic sign, or any other equipment which can be associated with, or utilized in conjunction with, the respective traffic control device 40. For example, if the traffic control device is a traffic light utilized on or along roads, streets, or intersections, the traffic control equipment 40F can be the actual traffic light device which is controlled or which can be controllable by the traffic control device 40.

The traffic control device 40 can also include a traffic speed sensor 40G. The traffic speed sensor 40G is also connected to the CPU 40A. The traffic speed sensor 40G can be any one or more of the well known electrical sensors, optical sensors, laser sensors, mechanical sensors, or pneumatic sensors, which can be utilized for determining the speed of travel of vehicles along a road or street or through an intersection.

The traffic speed sensor 40G can utilize radar signals or optical signals to determine the speed of vehicles. The traffic speed sensor 40G can also be any suitable device for counting the number of vehicles which travel past a predetermined point during a pre-specified time interval, which information can be utilized to determine an average speed of traffic flow. The traffic speed sensor 40G can be a physically integrated component of the traffic control device 40 or can be located separate and apart from same.

The traffic control device 40 can also include a transmitter(s) 40H, for transmitting signals and/or data and/or information to any one or more of the vehicle computers 20, to the central processing computer(s) 30, and/or to any other traffic control device(s) 40.

The traffic control device 40 can also include a receiver 40I, for receiving signals and/or data and/or information from any of the vehicle computers 20, from the central processing computer(s) 30, and/or from any other traffic control device(s) 40.

The traffic control device 40 can also include a database(s) 40J which can contain any and/or all of the data and/or information which may be needed and/or desired in performing the processing routines described herein as being performed by the traffic control device 40, such as, but not limited to, routines for controlling the operation of the traffic control device 40 and for controlling traffic control signal light activation, message generation and/or display, and any other operations performed by, or capable of being performed by, the respective traffic control device 40.

The database 40J can also contain data and/or information regarding the operating times, on/off frequencies, on/off cycle times, for any of the respective traffic control equipment (i.e. "on" time and duration for a green light, "on" time and duration of a displayed traffic message, etc.), and/or any other pre-programmed and/or programmable operating characteristics of the respective traffic control device 40.

The database 40J can also contain data and/or information for facilitating communications and/or for interfacing with any of the vehicles computers 20, with any of the central processing computers 30, and/or with any of the other traffic control devices 40, which may be utilized.

The database 40J can also contain information regarding the observed and/or recorded average traffic speed or the speed of travel of vehicles on a road or street and/or through an intersection, the average speed of travel of vehicles on a road or street and/or through an intersection, the average time a vehicle stops at a traffic control device (i.e. traffic light, etc.) or traffic signal (i.e. stop sign, yield sign, or other traffic sign(s)), the observed average speed of travel of vehicles on a road or street and/or in the vicinity of a traffic control device or traffic sign, the average speed of travel of vehicles on a road or street in the vicinity of a traffic control device or traffic sign, the average speed of travel of vehicles on a road or street in the absence of a traffic control device or traffic sign, and/or any other data and/or information regarding known, observed, or recorded, characteristics regarding travel in a geographic area.

The database 40J can also contain information regarding IP addresses for any of the central processing computers 30 and/or for any other traffic control devices 40 which are utilized in conjunction with the present invention.

The database 40J can also contain any other data and/or information described herein as being stored in and/or utilized by the respective vehicle computers 20 and/or central processing computers 30 which are utilized in conjunction with the apparatus and method of the present invention.

The data and/or information which is stored in the database 40J can be resident therein and/or can be obtained from, or loaded from, any number of compact discs (CDs), digital versatile discs (DVDs), magnetic tapes, or any other storage mediums. The information stored in the database 40J can also be downloaded from any of the central processing computer(s) 30 and/or from any of the other traffic control device(s) 40 utilized in conjunction with the present invention.

The traffic control device 40 can also include an output device 40K such as a printer, a modem, a fax/modem, or other output device, for providing data and/or information to the operator of the traffic control device 40.

The apparatus and method of the present invention can be utilized in a number of preferred embodiments in order to provide driving information, directions, and/or instructions, to a vehicle operator or occupant. In one preferred embodiment, the apparatus 100 can be utilized, and can operate, in a "stand alone" embodiment wherein the vehicle computer 20 performs all of the processing routines and/or functionality which can be provided by the present invention.

In a "stand alone" embodiment, the vehicle computer 20 will utilize data and/or information which is stored in its database 20H. The vehicle computer 20 can also process information which can be stored on, or which can be obtained from, a compact disc (CD), a digital video disc (DVD), a magnetic or other tape, and/or any other storage media capable of being utilized by the vehicle computer 20. In this regard, no data and/or information is received from any of the herein-described central processing computer(s) 30 and/or traffic control device(s) 40.

Figure 6:
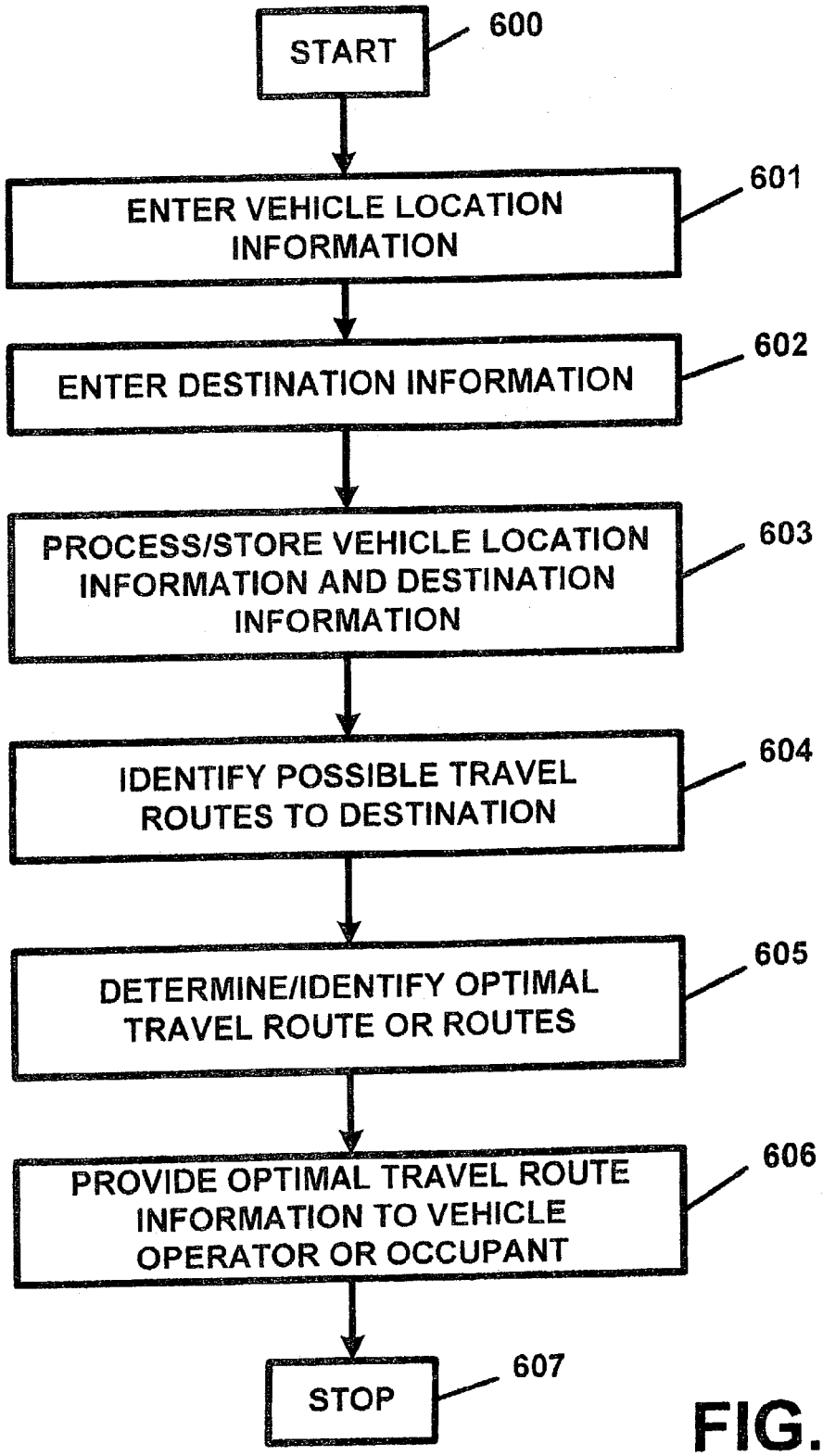
FIG. 6 illustrates a preferred embodiment method of utilizing the apparatus of the present invention, in flow diagram form.

FIG. 6 illustrates a flow diagram of the operation of the apparatus 100 of the present invention in a vehicle computer 20 "stand alone" embodiment. In the embodiment of FIG. 6, the apparatus 100 can be utilized in order to provide driving information, directions, and/or instructions, for directing the vehicle operator or occupant from a present or known location to a pre-determined or pre-selected destination via an optimal travel route. Typically, the term "optimal travel route" can mean the travel route having the shortest travel time.

Depending upon the circumstances, however, the "optimal travel route", can also be defined to refer to the travel route having the fewest or minimum number of turns along a travel route to a destination, the fewest or minimum number of traffic lights, traffic signs, or other traffic control devices, which are encountered along a travel route to a destination, the fewest or minimum number of travel encumbrances (i.e. road work, construction, accidents, bridges, tolls, etc.) which are encountered along a travel route to a destination, and/or any other criteria which can be preselected or dictated by the vehicle operator or occupant.

The apparatus 100 and, in particular, the vehicle computer 20, can identify any number of optimal travel routes as it is recognized that oftentimes two or more travel routes may qualify as optimal routes.

With reference to FIG. 6, the operation of the apparatus 100 commences at step 600. At step 601, the vehicle operator or occupant can enter information regarding the present location of the vehicle into the vehicle computer 20. The vehicle location information can be entered manually, via the user input device 20D, and/or automatically, via the global positioning system device 20J. In an instance when present location information is entered via the user input device 20D, the location or position can be entered in the first instance by the vehicle operator or occupant or can be selected from a menu screen of locations or positions in the area of service.

In an instance when present location information is entered via the global positioning system device 20J, the vehicle operator or occupant can activate the global positioning system device 20J, such as via the user input device 20D, and the global positioning system device 20J can automatically determine and enter vehicle position or location information, which can thereafter be stored and processed by the vehicle computer 20.

At step 602, the vehicle operator or occupant can enter information regarding the desired destination into the user input device 20D. The destination information can be entered in the first instance by the vehicle operator or occupant or can be selected from a menu screen of destinations in the particular area of service.

At step 603, the vehicle computer 20 and, in particular, the CPU 20A, will process and store the present location or position information and the destination information.

At step 604, the vehicle computer 20 will identify all possible travel routes from a present location to the destination. At step 604, the vehicle computer 20 will identify all travel routes to the destination by taking into account the presence of one-way only streets, two-way streets, and/or other travel or traffic rules, in the geographic area of travel.

At step 604, the vehicle computer 20 can also determine the travel distance along each road or street, or segment thereof, for each leg of a travel route, for each of the identified possible travel routes. At step 604, the vehicle computer 20 can also identify intersections which exist along each of the possible travel routes. At step 604, the vehicle computer 20 can also identify the existence of traffic control devices, traffic lights, traffic signals, etc., which exist along a travel route, for each of the possible travel routes.

At step 605, the vehicle computer 20 can process the information regarding the possible travel routes and determine the optimal travel route or optimal travel routes.

In one embodiment of step 605, the vehicle computer 20 can determine the optimal travel route or routes by utilizing information stored in the database 20H which does not include the states of any of the various traffic control devices 40 which may exist in a geographic area. In this manner, for example, the optimal travel route or routes can be determined when the green light on and off times for a traffic light or traffic lights along possible travel routes are not known. In such instances, the travel times through intersections or segments of roads or streets having these traffic lights can be approximated and stored in the database 20H and/or can be defined to be an unknown variable.

In a similar manner, the travel times through intersections or segments of roads or streets having these traffic lights can be approximated and stored in the database 20H and/or can be defined to be an unknown variable.

In another embodiment, the states of any of the various traffic control devices 40 which may exist in a geographic area can be known and can be pre-stored in the database 20H. In this manner, for example, the optimal travel route or routes can be determined by utilizing information regarding the time or times when a traffic light turns green and the duration of the green light, for each traffic light along the possible travel routes.

At step 605, the vehicle computer 30 can determine the optimal travel route or routes by generating an equation representing the expected travel time along each of the possible travel routes. An example of such an equation for a route involving travel from a present location, along road 1, along road 2, through an intersection having traffic light 3, along road 4, through an intersection having traffic light 5, and along road 6 until arrival at the destination, can be as follows:

$$TravTime = \frac{Dist1}{Speed1} + \frac{Dist2}{Speed2} + TC3 + \frac{Dist4}{Speed4} + TC5 + \frac{Dist6}{Speed6}$$

Where:

TravTime=the expected travel time from the present location to the destination.

DistN=the distance of travel along the Nth road.

SpeedN=the average speed of travel of vehicles along the Nth road.

TCN=the average time of travel along a road, or through an intersection, having Nth traffic control device.

DistN/Speed N=the amount of time to travel along the Nth road

By assigning a number or variable to each road or street segment, to each intersection, and to each traffic control device, which is located in a geographic area, every possible travel route from any present location in the area to any destination in the area can be represented by an equation. In instances where a road or street, a segment of a road or of a street, an intersection, or a traffic control device, is not utilized along a travel route, the entry for that respective road or street, intersection, or traffic control device, would be zero (0) and, therefore, would be left out of the equation for that travel route.

At step 605, the vehicle computer 20 can determine the equations for each of the possible travel routes. In the case of determining a travel route or routes having minimum travel times, the above equation can be utilized. In a similar manner, where minimum travel distance may be the criteria for an optimal travel route or routes, a distance equation including distances along roads, streets, or segments thereof, and distances through intersections, can be utilized in a simple distance equation.

In another embodiment, the optimal travel route can be determined by identifying the travel route which involves the minimum number of turns along a travel route to a destination.

At step 605, the vehicle computer 20 will determine the optimal travel route or route. In the preferred embodiment, the optimal travel route or routes are selected based on the minimum expected travel time or times. At step 605, the vehicle computer 20 will determine the expected travel time for each of the possible travel routes by computing the expected travel times for each possible travel route, such as by using the above-described equation.

In one embodiment, where no information regarding the on times or on duration for a green light(s) of a traffic signal(s) are known or stored, but where an estimated average travel time though an intersection or road segment having a traffic signal(s) is known, the vehicle computer 20 can utilize the estimated average travel time or times to calculate the estimated travel times for each of the possible travel routes.

In another embodiment, where green light on times and duration are known, the amount of time spent at an intersection or road section having the traffic light can be estimated by calculating the estimated time of arrival at the respective intersection or road section and determining whether the light would be green or the amount of time which would have to elapse until the light turns green. In this manner, the time to travel through the intersection can be estimated.

In another embodiment, where no information regarding the on times or on duration for a green light(s) is known or stored, and no estimated average travel time(s) through an intersection or road segment having a traffic signal(s) is available, the unknown information can be represented by an unknown variable. The vehicle computer 20 can then solve for the unknown variable(s) and the expected travel times by utilizing linear programming routines which are well known to those skilled in the art of linear programming and operations research.

At step 605, the vehicle computer 20 can identify the optimal travel route to the destination and compile the information regarding the travel directions and/or instructions regarding the optimal travel route. At step 605, the vehicle computer 20 can also generate a message containing the travel directions and/or instructions corresponding to the optimal travel route. In an embodiment where two optimal travel routes are requested or desired, the vehicle computer 20 can identify the two optimal travel routes to the destination and compile the above-described information regarding the two optimal travel routes.

It is important to note that, at step 605, the vehicle computer 20, in one embodiment, can determine and/or identify the optimal travel route independently of information regarding the operating characteristics (i.e. traffic light green light on time(s), green light on time schedule(s), and green light on time duration(s)). In another embodiment, the vehicle computer 20 can determine and/or identify the optimal travel route by utilizing information regarding the operating characteristics of the traffic control devices.

At step 606, the vehicle computer 20 can provide the message along with the travel directions and/or instructions corresponding to the optimal travel route, to the vehicle operator or occupant by any one or more of displaying the travel directions or instructions on the display device 20E, by outputting the travel directions or instructions on the output device 20J, and/or by providing audible travel directions or instructions via the voice synthesizing device system 20K.

Thereafter, at step 606, the vehicle operator can utilize the travel directions or instructions in traveling to the destination. Thereafter, the operation of the apparatus 100 will cease at step 607.

In another preferred embodiment, the vehicle computer 20 can be utilized in conjunction with the central processing computer(s) 30 and/or with any one or more of the traffic control devices 40 which are utilized in conjunction with the present invention.

Figure 7A:
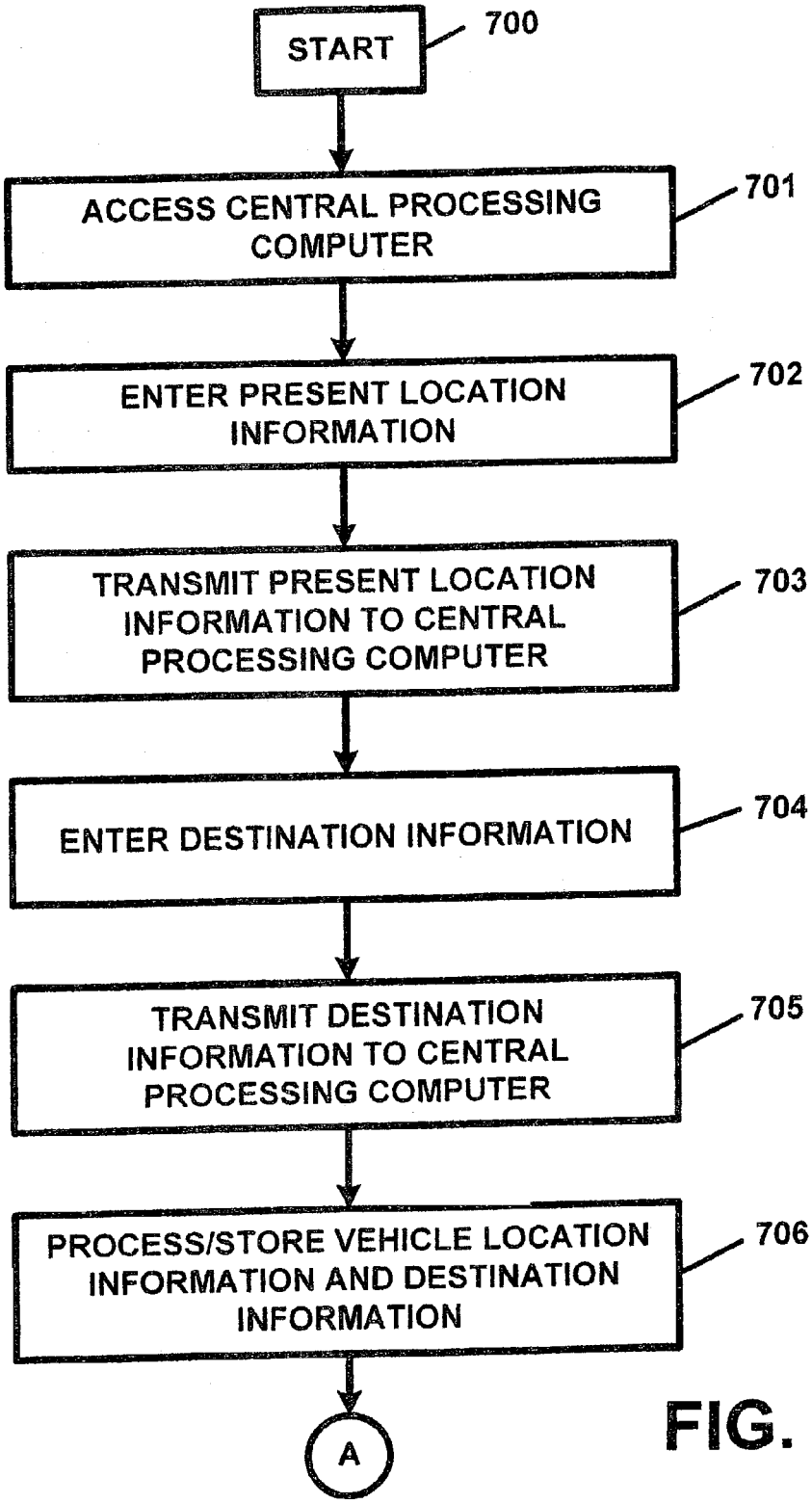
FIGS. 7A and 7B illustrate another preferred embodiment method of utilizing the apparatus of the present invention, in flow diagram form.
Figure 7B:
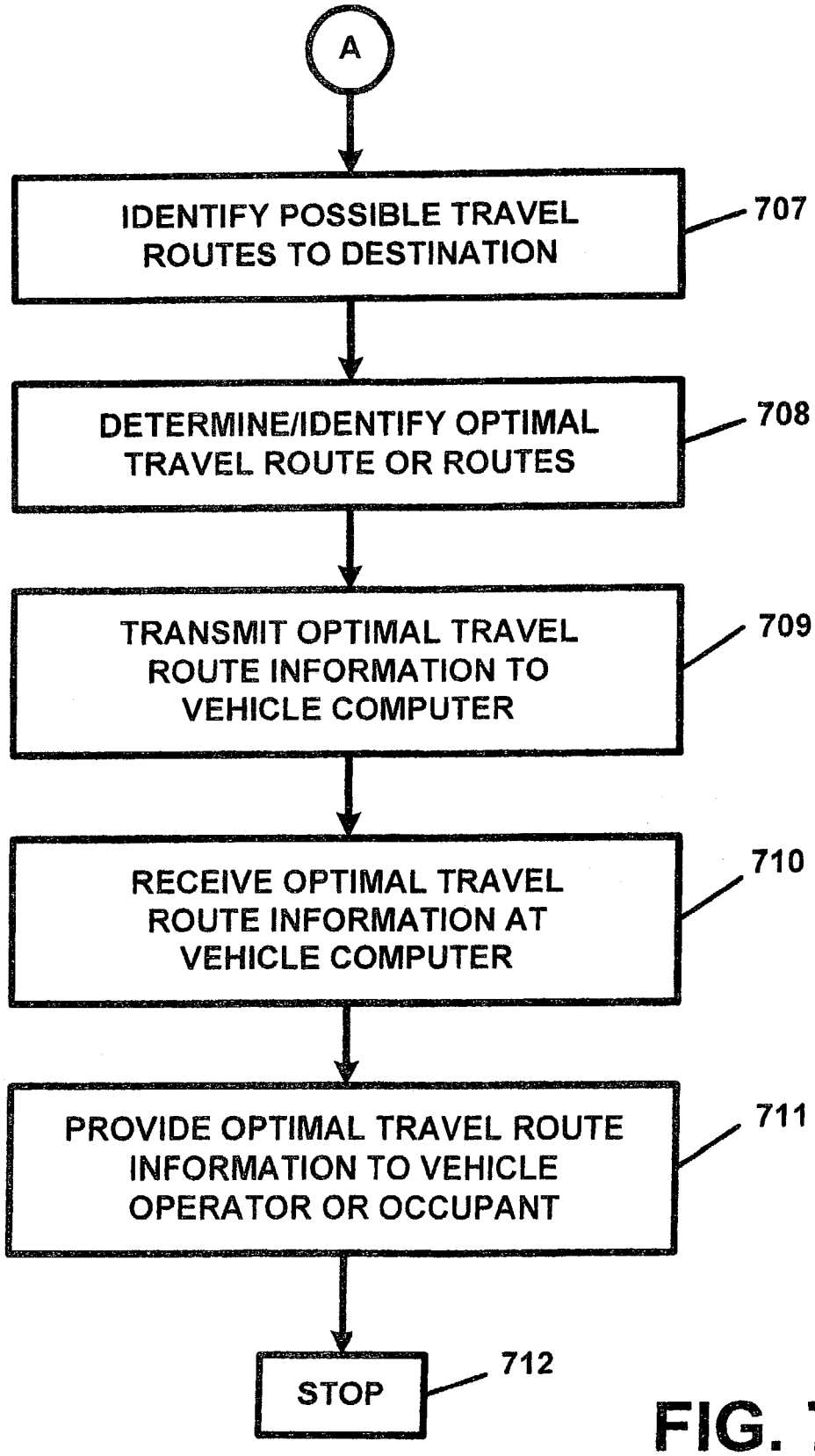

FIGS. 7A and 7B illustrate a flow diagram of the operation of the apparatus 100 of the present invention in an embodiment wherein the vehicle computer 20 is utilized in conjunction with at least one central processing computer 30. In the embodiment of FIGS. 7A and 7B, the apparatus 100 can be utilized in order to provide driving information, directions, and/or instructions, for directing the vehicle operator or occupant from a present or known location to a pre-determined or pre-selected destination via an optimal travel route. As noted herein, the term "optimal travel route" can mean the travel route having the shortest travel time.

As further noted herein, and depending upon the circumstances, the "optimal travel route", can also be defined to refer to the travel route having the fewest or minimum number of turns along a travel route to a destination, the fewest or minimum number of traffic lights, traffic signs, or other traffic control devices, which are encountered along a travel route to a destination, the fewest or minimum number of travel encumbrances (i.e. road work, construction, accidents, bridges, tolls, etc.) which are encountered along a travel route to a destination, and/or any other criteria which can be pre-selected or dictated by the vehicle operator or occupant.

The central processing computer 30 can identify the optimal travel route or any number of optimal travel routes as it is recognized that two or more travel routes may qualify as optimal routes.

With reference to FIGS. 7A and 7B, the operation of the apparatus 100 commences at step 700. At step 701, the vehicle operator or occupant can access the central processing computer 30 via the vehicle computer 20. At step 702, the vehicle operator or occupant can enter information regarding the present location of the vehicle into the vehicle computer 20.

The vehicle location information can be entered manually, via the user input device 20D, or automatically, via the global positioning system device 20J. In an instance when present location information is entered via the user input device 20D, the location or position can be entered in the first instance by the vehicle operator or occupant or can be selected from a menu screen of locations or positions in the area of service.

In an instance when present location information is entered via the global positioning system device 20J, the vehicle operator or occupant can activate the global positioning system device 20J, via the user input device 20D, and the global positioning system device 20J can automatically determine and enter vehicle position or location information which can thereafter be stored and processed by the vehicle computer 20.

At step 703, the information entered at step 702 can be transmitted to and received by the central processing computer 30.

At step 704, the vehicle operator or occupant can enter information regarding the desired destination into the input device 20D. The destination information can be entered in the first instance by the vehicle operator or occupant or can be selected from a menu screen of destinations in the particular area of service.

At step 705, the destination information entered at step 704 can be transmitted to and received by the central processing computer 30.

At step 706, the central processing computer 30 will process and store the present location or position information and the destination information.

At step 707, the central processing computer 30 will identify all possible travel routes from a present location to the destination. At step 707, the central processing computer 30 will identify all travel routes to the destination by taking into account the presence of one-way only streets, two-way streets, and/or other travel or traffic rules, in the geographic area of travel.

At step 707, the central processing computer 30 can also determine the travel distance along each road or street, or segment thereof, for each leg of a travel route, for each of the identified possible travel routes. At step 707, the central processing computer 30 can also identify intersections which exist along each of the possible travel routes. At step 707, the central processing computer 30 can also identify the existence of traffic control devices, traffic lights, traffic signals, etc., which exist along a travel route, for each of the possible travel routes.

At step 708, the central processing computer 30 can process the information regarding the possible travel routes and determine the optimal travel route or optimal travel routes. At any time during step 708, the central processing computer 30 can utilize any of the herein-described data and/or information which may be stored in the database 30H.

The central processing computer 30 can also obtain any other needed and/or desired information such as, for example, a traffic control device green light on-time and green light on duration, traffic speed through, or at, an intersection or road section in the vicinity of a traffic control device 40, by accessing and obtaining the information from any of the traffic control devices 40 which are identified as being on the identified possible travel route or travel routes.

The central processing computer(s) 30 and the traffic control devices 40 described as being utilized in conjunction with the apparatus 100 are capable of communication with each other in a bi-directional manner. In this regard, the central processing computer 30 can obtain any of the data and/or information, described herein as being utilized in any of the herein-described processing routines, from a respective traffic control device 40, in real-time and/or otherwise.

In one embodiment of step 708, the central processing computer 30 can determine the optimal travel route or routes by utilizing information stored in the database 30H which may or may not include information regarding the states of any of the various traffic control devices 40 which may exist in a geographic area. In another embodiment, the central processing computer 30 can obtain any missing and/or desired information directly from a respective traffic control device(s) 40 and/or from any other central processing computers 30 which may be utilized in conjunction with the apparatus 100.

In an embodiment where certain data and/or information is not available to the central processing computer 30 and/or the central processing computer 30 cannot obtain same from an external source, the optimal travel route or routes can be determined by utilizing estimated and/or stored estimations in a manner similar to that described above in conjunction with the embodiment of FIG. 6. For example, when the green light on and off times for a traffic light or traffic lights along possible travel routes are not known, the travel times through intersections or segments of roads or streets having these traffic lights can be approximated and stored in the database 30H and/or can be defined to be an unknown variable.

In a similar manner, the travel times through intersections or segments of roads or streets having these traffic lights can be approximated and stored in the database 30H and/or can be defined to be an unknown variable. In other instances, any unknown parameters or information can be defined to be unknown variables.

In another embodiment, the states of any of the various traffic control devices 40 which may exist in a geographic area can be known and can be pre-stored in the database 30H.

At step 708, the central processing computer 30 can determine the optimal travel route or routes by generating an equation representing the expected travel time along each of the possible travel routes. In one embodiment, the central processing computer 30 can utilize the equation:

$$TravTime = \frac{Dist1}{Speed1} + \frac{Dist2}{Speed2} + TC3 + \frac{Dist4}{Speed4} + TC5 + \frac{Dist6}{Speed6}$$

Where:

TravTime=the expected travel time from the present location to the destination.

DistN=the distance of travel along the Nth road.

SpeedN=the average speed of travel of vehicles along the Nth road.

TCN=the average time of travel along a road, or through an intersection, having Nth traffic control device.

DistN/Speed N=the amount of time to travel along the Nth Road which was presented above in connection with the description of Step 605 of FIG. 6, along with the information and conventions described above as being utilized regarding the assigning of respective numbers or variables to respective road or street segments, to intersections, and to traffic control devices, which are located in a geographic area. In this manner, the central processing computer 30 can utilize and/or perform all of the processing routines and/or processing conventions described herein as being performed by the vehicle computer 20 in the embodiment of FIG. 6.

At step 708, the central processing computer 30 can determine the equations for each of the possible travel routes. In the case of determining a travel route or routes having minimum travel times, the equation presented above in the description of the embodiment of FIG. 6 can be utilized.

In a similar manner, wherein minimum travel distance may be the criteria for an optimal travel route or routes, a distance equation, including distances along roads, streets, or segments thereof, and distances through intersections, can be utilized in a simple distance equation.

In another embodiment, the optimal travel route can be determined by identifying the travel route which involves the minimum number of turns along a travel route to a destination.

At step 708, the central processing computer 30 can determine the optimal travel route. In the preferred embodiment, the optimal travel route can be selected based on the minimum expected travel time.

At step 708, the central processing computer 30 can determine the expected travel time for each of the possible travel routes by computing the expected travel times for each possible travel route such as by using the above-described equation.

In one embodiment, where no information regarding the on times or on duration for a green light(s) of a traffic signal(s) are known or stored, but where an estimated average travel time though an intersection or road segment having a traffic signal(s) is known, the central processing computer 30 can utilize the estimated average travel time or times to calculate the estimated travel times for each of the possible travel routes.

In another embodiment, where green light on times and duration are known, the amount of time spent at an intersection or road section having the traffic light can be estimated by calculating the estimated time of arrival at the respective intersection or road section and determining whether the light would be green or the amount of time which would have to elapse until the light turns green. In this manner, the time to travel through the intersection can be estimated.

In another embodiment, where no information regarding the on times or on duration for a green light(s) is known or stored, and no estimated average travel time(s) through an intersection or road segment having a traffic signal(s) is available, the unknown information can be represented by an unknown variable. The central processing computer 30 can then solve for the unknown variable(s) and the expected travel times by utilizing linear programming routines which are well known to those skilled in the art of linear programming and operations research.

At step 708, the central processing computer 30 can identify the optimal travel route to the destination and compile the information regarding the travel directions and/or instructions regarding the optimal travel route. At step 708, the central processing computer 30 can also generate a message containing the travel directions and/or instructions corresponding to the optimal travel route.

In an embodiment where two optimal travel routes are requested or desired, the central processing computer 30 can identify the two optimal travel routes to the destination and compile the information regarding the optimal travel routes.

It is important to note that, at step 708, the central processing computer 30, in one embodiment, can determine and/or identify the optimal travel route independently of information regarding the operating characteristics (i.e. traffic light green light on time(s), green light on time schedule(s), and green light on time duration(s)). In another embodiment, the central processing computer 30 can determine and/or identify the optimal travel route by utilizing information regarding the operating characteristics of the traffic control devices.

At step 709, the central processing computer 30 can transmit the message containing the travel directions and/or instructions corresponding to the optimal travel route, to the vehicle computer 20. At step 710, the vehicle computer 20 will receive the message and optimal travel route information.

At step 711, the vehicle computer 20 will provide the information contained in the message along with the travel directions and/or instructions corresponding to the optimal travel route, to the vehicle operator or occupant by any one or more of displaying the travel directions or instructions on the display device 20E, by outputting the travel directions or instructions via the output device 20J, or by providing audible travel directions or instructions via the voice synthesizing device system 20K.

Thereafter, at step 711, the vehicle operator can utilize the travel directions or instructions in traveling to the destination. Thereafter, the operation of the apparatus 100 will cease at step 712.

In any and/or all of the embodiments described herein, the central processing computer 30 can, at any time, generate an information request message and transmit same to a traffic control device(s) in order to obtain operating characteristic information such as, green light on time or times, green light on time schedule or schedules, and/or green light on time duration or durations, from the respective device(s).

The respective traffic control device or devices 40 can receive the request, process same, and generate a response message. Thereafter, the response message can be transmitted from the traffic control device 40 to the central processing computer 30 and be received and utilized by the central processing computer 30 in performing any of the herein-described processing routines and/or functionality.

While the present invention has been described and illustrated in various preferred and alternate embodiments, such descriptions are merely illustrative of the present invention and are not to be construed to be limitations thereof. In this regard, the present invention encompasses all modifications, variations, and/or alternate embodiments, with the scope of the present invention being limited only by the claims which follow.

What is claimed is:

1. A computer-assisted method of navigating roads in an area, the method comprising:

obtaining traffic control device information for the area:

receiving a request for a travel route between a first point and a second point within the area;

identifying a plurality of travel routes between the first and the second points, wherein each travel route of the plurality of travel routes is identified using the traffic control device information;

selecting a first route from the plurality of travel routes; and providing directions for travel between the first point and the second point along the first route;

wherein:

selecting a first route comprises choosing the first route so that travel time along the first route is shorter than travel time along any other travel route of the plurality of travel routes;

obtaining traffic control device information comprises obtaining green time on schedule for one or more traffic lights at one or more intersections in the area; and choosing comprises estimating time of arrival at at least one intersection of the one or more intersections, and using on time schedule of traffic light of the at least one intersection to determine an amount of time from the estimated time of arrival until traffic light of the at least one intersection turns green.

2. A method according to claim 1, wherein obtaining traffic control device information comprises obtaining vehicle speed information from a traffic control device.

3. A method according to claim 1, further comprising obtaining position information for at least one of the first and second points from a global positioning system.

4. A method according to claim 1, further comprising selecting a second route from the plurality of travel routes using the traffic control device information.

5. A method according to claim 4, further comprising:

providing directions for travel between the first point and the second point along the second route.

6. A method according to claim 4, wherein:

selecting a second route comprises choosing the second route so that number of turns along the second route is not greater than number of turns along any other travel route of the plurality of travel routes.

7. A method according to claim 4, wherein:

selecting a second route comprises choosing the second route so that travel distance along the second route is shorter than travel distance along any other travel route of the plurality of travel routes.

8. A method according to claim 1, further comprising obtaining position information for at least one of the first and second points from a user input device.

9. A method according to claim 1, further comprising obtaining position information for at least one of the first and second points from a microphone.

10. A method according to claim 1, wherein providing directions comprises displaying the directions.

11. A method according to claim 1, wherein providing directions comprises using a voice synthesizing device and a speaker to provide audible travel directions.

12. A method according to claim 1, wherein the steps of identifying and selecting are performed at a central processing computer, the method further comprising:

transmitting position information for the first and second points from a vehicle to the central processing computer; and receiving the directions from the central processing computer.

13. A method according to claim 1, wherein the method is performed at least in part using a personal computer.

14. A method according to claim 1, wherein the method is performed at least in part using a personal digital assistant.

15. A method according to claim 1, wherein the step of selecting comprises identifying intersections along each travel route of the plurality of travel routes.

* * * * *